US011621156B2

(12) United States Patent
Kozlov et al.

(10) Patent No.: US 11,621,156 B2
(45) Date of Patent: Apr. 4, 2023

(54) MULTI-REFLECTING TIME OF FLIGHT MASS ANALYSER

(71) Applicant: Micromass UK Limited, Wilmslow (GB)

(72) Inventors: Boris Kozlov, Manchester (GB); Irina Vasileva, Manchester (GB)

(73) Assignee: Micromass UK Limited, Wilmslow (GB)

( * ) Notice: Subject to any disclaimer, the term of this patent is extended or adjusted under 35 U.S.C. 154(b) by 91 days.

(21) Appl. No.: 17/054,327

(22) PCT Filed: May 3, 2019

(86) PCT No.: PCT/GB2019/051235
§ 371 (c)(1),
(2) Date: Nov. 10, 2020

(87) PCT Pub. No.: WO2019/215429
PCT Pub. Date: Nov. 14, 2019

(65) Prior Publication Data

US 2021/0134582 A1 May 6, 2021

(30) Foreign Application Priority Data

May 10, 2018 (GB) ..... 1807626

(51) Int. Cl.
*H01J 49/40* (2006.01)
*H01J 49/00* (2006.01)
(Continued)

(52) U.S. Cl.
CPC ..... *H01J 49/406* (2013.01); *H01J 49/0031* (2013.01); *H01J 49/401* (2013.01);
(Continued)

(58) Field of Classification Search
CPC .... H01J 49/406; H01J 49/0031; H01J 49/401; H01J 49/4245; H01J 49/446; H01J 49/486
(Continued)

(56) References Cited

U.S. PATENT DOCUMENTS 3,898,452 A 8/1975 Hertel
4,390,784 A 6/1983 Browning et al.
(Continued)

FOREIGN PATENT DOCUMENTS

CA 2412657 C 5/2003
CN 101369510 A 2/2009
(Continued)

OTHER PUBLICATIONS

Collision Frequency, https://en.wikipedia.org/wiki/Collision_frequency accessed Aug. 17, 2021.
(Continued)

*Primary Examiner* — Kiet T Nguyen
(74) *Attorney, Agent, or Firm* — Goodwin Procter LLP

(57) ABSTRACT

A mass spectrometer comprising: an ion energy filter 14 arranged and configured to filter ions according to their kinetic energy and so as to only transmit ions having a component of kinetic energy in a first dimension (z-dimension) that is within a selected range; and a multi-reflecting time of flight mass analyser or mass separator 1 having an ion accelerator 6, and two gridless ion mirrors 2 that are elongated in the first dimension (z-dimension) and configured to reflect ions multiple times in a second orthogonal dimension (x-dimension), wherein the ion accelerator 6 is arranged to receive ions from the energy filter 14 and accelerate the ions into one of the ion mirrors 2.

18 Claims, 5 Drawing Sheets

(51) Int. Cl.
*H01J 49/42* (2006.01)
*H01J 49/44* (2006.01)
*H01J 49/48* (2006.01)

(52) U.S. Cl.
CPC ..... *H01J 49/4245* (2013.01); *H01J 49/446* (2013.01); *H01J 49/486* (2013.01)

(58) Field of Classification Search
USPC ..... 250/287, 282
See application file for complete search history.

(56) References Cited

U.S. PATENT DOCUMENTS 4,691,160 A 9/1987 Ino
4,731,532 A 3/1988 Frey et al.
4,855,595 A 8/1989 Blanchard
5,017,780 A 5/1991 Kutscher et al.
5,107,109 A 4/1992 Stafford, Jr. et al.
5,128,543 A 7/1992 Reed et al.
5,202,563 A 4/1993 Cotter et al.
5,331,158 A 7/1994 Dowell
5,367,162 A 11/1994 Holland et al.
5,396,065 A 3/1995 Myerholtz et al.
5,435,309 A 7/1995 Thomas et al.
5,464,985 A 11/1995 Cornish et al.
5,619,034 A 4/1997 Reed et al.
5,652,427 A 7/1997 Whitehouse et al.
5,654,544 A 8/1997 Dresch
5,689,111 A 11/1997 Dresch et al.
5,696,375 A 12/1997 Park et al.
5,719,392 A 2/1998 Franzen
5,763,878 A 6/1998 Franzen
5,777,326 A 7/1998 Rockwood et al.
5,834,771 A 11/1998 Yoon et al.
5,847,385 A 12/1998 Dresch
5,869,829 A 2/1999 Dresch
5,896,829 A 4/1999 Rothenberg et al.
5,955,730 A 9/1999 Kerley et al.
5,994,695 A 11/1999 Young
6,002,122 A 12/1999 Wolf
6,013,913 A 1/2000 Hanson
6,020,586 A 2/2000 Dresch et al.
6,080,985 A 6/2000 Welkie et al.
6,107,625 A 8/2000 Park
6,160,256 A 12/2000 Ishihara
6,198,096 B1 3/2001 Le Cocq
6,229,142 B1 5/2001 Bateman et al.
6,271,917 B1 8/2001 Hagler
6,300,626 B1 10/2001 Brock et al.
6,316,768 B1 11/2001 Rockwood et al.
6,337,482 B1 1/2002 Francke
6,384,410 B1 5/2002 Kawato
6,393,367 B1 5/2002 Tang et al.
6,437,325 B1 8/2002 Reilly et al.
6,455,845 B1 9/2002 Li et al.
6,469,295 B1 10/2002 Park
6,489,610 B1 12/2002 Barofsky et al.
6,504,148 B1 1/2003 Hager
6,504,150 B1 1/2003 Verentchikov et al.
6,534,764 B1 3/2003 Verentchikov et al.
6,545,268 B1 4/2003 Verentchikov et al.
6,570,152 B1 5/2003 Hoyes
6,576,895 B1 6/2003 Park
6,580,070 B2 6/2003 Cornish et al.
6,591,121 B1 7/2003 Madarasz et al.
6,614,020 B2 9/2003 Cornish
6,627,877 B1 9/2003 Davis et al.
6,646,252 B1 11/2003 Gonin
6,647,347 B1 11/2003 Roushall et al.
6,664,545 B2 12/2003 Kimmel et al.
6,683,299 B2 1/2004 Fuhrer et al.
6,694,284 B1 2/2004 Nikoonahad et al.
6,717,132 B2 4/2004 Franzen
6,734,968 B1 5/2004 Wang et al.
6,737,642 B2 5/2004 Syage et al.
6,744,040 B2 6/2004 Park
6,744,042 B2 6/2004 Zajfman et al.
6,747,271 B2 6/2004 Gonin et al.
6,770,870 B2 8/2004 Vestal
6,782,342 B2 8/2004 LeGore et al.
6,787,760 B2 9/2004 Belov et al.
6,794,643 B2 9/2004 Russ, IV et al.
6,804,003 B1 10/2004 Wang et al.
6,815,673 B2 11/2004 Plomley et al.
6,833,544 B1 12/2004 Campbell et al.
6,836,742 B2 12/2004 Brekenfeld
6,841,936 B2 1/2005 Keller et al.
6,861,645 B2 3/2005 Franzen
6,864,479 B1 3/2005 Davis et al.
6,870,156 B2 3/2005 Rather
6,870,157 B1 3/2005 Zare
6,872,938 B2 3/2005 Makarov et al.
6,888,130 B1 5/2005 Gonin
6,900,431 B2 5/2005 Belov et al.
6,906,320 B2 6/2005 Sachs et al.
6,940,066 B2 9/2005 Makarov et al.
6,949,736 B2 9/2005 Ishihara
7,034,292 B1 4/2006 Whitehouse et al.
7,071,464 B2 7/2006 Reinhold
7,084,393 B2 8/2006 Fuhrer et al.
7,091,479 B2 8/2006 Hayek
7,126,114 B2 10/2006 Chernushevich
7,196,324 B2 3/2007 Verentchikov
7,217,919 B2 5/2007 Boyle et al.
7,221,251 B2 5/2007 Menegoli et al.
7,326,925 B2 2/2008 Verentchikov et al.
7,351,958 B2 4/2008 Vestal
7,365,313 B2 4/2008 Fuhrer et al.
7,385,187 B2 6/2008 Verentchikov et al.
7,388,197 B2 6/2008 McLean et al.
7,399,957 B2 7/2008 Parker et al.
7,423,259 B2 9/2008 Hidalgo et al.
7,498,569 B2 3/2009 Ding
7,501,621 B2 3/2009 Willis et al.
7,504,620 B2 3/2009 Sato et al.
7,521,671 B2 4/2009 Kirihara et al.
7,541,576 B2 6/2009 Belov et al.
7,582,864 B2 9/2009 Verentchikov
7,608,817 B2 10/2009 Flory
7,663,100 B2 2/2010 Vestal
7,675,031 B2 3/2010 Konicek et al.
7,709,789 B2 5/2010 Vestal et al.
7,728,289 B2 6/2010 Naya et al.
7,745,780 B2 6/2010 McLean et al.
7,755,036 B2 7/2010 Satoh
7,772,547 B2 8/2010 Verentchikov
7,800,054 B2 9/2010 Fuhrer et al.
7,825,373 B2 11/2010 Willis et al.
7,863,557 B2 1/2011 Brown
7,884,319 B2 2/2011 Willis et al.
7,932,491 B2 4/2011 Vestal
7,982,184 B2 7/2011 Sudakov
7,985,950 B2 7/2011 Makarov et al.
7,989,759 B2 8/2011 Holle
7,999,223 B2 8/2011 Makarov et al.
8,017,907 B2 9/2011 Willis et al.
8,017,909 B2 9/2011 Makarov et al.
8,063,360 B2 11/2011 Willis et al.
8,080,782 B2 12/2011 Hidalgo et al.
8,093,554 B2 1/2012 Makarov
8,237,111 B2 8/2012 Golikov et al.
8,354,634 B2 1/2013 Green et al.
8,373,120 B2 2/2013 Verentchikov
8,395,115 B2 3/2013 Makarov et al.
8,492,710 B2 7/2013 Fuhrer et al.
8,513,594 B2 8/2013 Makarov
8,633,436 B2 1/2014 Ugarov
8,637,815 B2 1/2014 Makarov et al.
8,642,948 B2 2/2014 Makarov et al.
8,642,951 B2 2/2014 Li
8,648,294 B2 2/2014 Prather et al.
8,653,446 B1 2/2014 Mordehai et al.
8,658,984 B2 2/2014 Makarov et al.
8,680,481 B2 3/2014 Giannakopulos et al.

(56) References Cited

U.S. PATENT DOCUMENTS 8,723,108 B1 5/2014 Ugarov
8,735,818 B2 5/2014 Kovtoun et al.
8,772,708 B2 7/2014 Kinugawa et al.
8,785,845 B2 7/2014 Loboda
8,847,155 B2 9/2014 Vestal
8,853,623 B2 10/2014 Verenchikov
8,884,220 B2 11/2014 Hoyes et al.
8,921,772 B2 12/2014 Verenchikov
8,952,325 B2 2/2015 Giles et al.
8,957,369 B2 2/2015 Makarov
8,975,592 B2 3/2015 Kobayashi et al.
9,048,080 B2 6/2015 Verenchikov et al.
9,082,597 B2 7/2015 Willis et al.
9,082,604 B2 7/2015 Verenchikov
9,099,287 B2 8/2015 Giannakopulos
9,136,101 B2 9/2015 Grinfeld et al.
9,147,563 B2 9/2015 Makarov
9,196,469 B2 11/2015 Makarov
9,207,206 B2 12/2015 Makarov
9,214,322 B2 12/2015 Kholomeev et al.
9,214,328 B2 12/2015 Hoyes et al.
9,281,175 B2 3/2016 Haufler et al.
9,312,119 B2 4/2016 Verenchikov
9,324,544 B2 4/2016 Rather
9,373,490 B1 6/2016 Nishiguchi et al.
9,396,922 B2 7/2016 Verenchikov et al.
9,417,211 B2 8/2016 Verenchikov
9,425,034 B2 8/2016 Verentchikov et al.
9,472,390 B2 10/2016 Verenchikov et al.
9,514,922 B2 12/2016 Watanabe et al.
9,576,778 B2 2/2017 Wang
9,595,431 B2 3/2017 Verenchikov
9,673,033 B2 6/2017 Grinfeld et al.
9,679,758 B2 6/2017 Grinfeld et al.
9,683,963 B2 6/2017 Verenchikov
9,728,384 B2 8/2017 Verenchikov
9,779,923 B2 10/2017 Verenchikov
9,786,484 B2 10/2017 Willis et al.
9,786,485 B2 10/2017 Ding et al.
9,865,441 B2 1/2018 Damoc et al.
9,865,445 B2 1/2018 Verenchikov et al.
9,870,903 B2 1/2018 Richardson et al.
9,870,906 B1 1/2018 Quarmby et al.
9,881,780 B2 1/2018 Verenchikov et al.
9,899,201 B1 2/2018 Park
9,922,812 B2 3/2018 Makarov
9,941,107 B2 4/2018 Verenchikov
9,972,483 B2 5/2018 Makarov
10,006,892 B2 6/2018 Verenchikov
10,037,873 B2 7/2018 Wang et al.
10,141,175 B2 11/2018 Verentchikov et al.
10,141,176 B2 11/2018 Stewart et al.
10,163,616 B2 12/2018 Verenchikov et al.
10,186,411 B2 1/2019 Makarov
10,192,723 B2 1/2019 Verenchikov et al.
10,290,480 B2 5/2019 Crowell et al.
10,373,815 B2 8/2019 Crowell et al.
10,388,503 B2 8/2019 Brown et al.
10,593,525 B2 3/2020 Hock et al.
10,593,533 B2 3/2020 Hoyes et al.
10,622,203 B2 4/2020 Veryovkin et al.
10,629,425 B2 4/2020 Hoyes et al.
10,636,646 B2 4/2020 Hoyes et al.
2001/0011703 A1 8/2001 Franzen
2001/0030284 A1 10/2001 Dresch et al.
2002/0030159 A1 3/2002 Chernushevich et al.
2002/0107660 A1 8/2002 Nikoonahad et al.
2002/0190199 A1 12/2002 Li
2003/0010907 A1 1/2003 Hayek et al.
2003/0111597 A1 6/2003 Gonin et al.
2003/0232445 A1 12/2003 Fulghum
2004/0026613 A1 2/2004 Bateman et al.
2004/0084613 A1 5/2004 Bateman et al.
2004/0108453 A1 6/2004 Kobayashi et al.
2004/0119012 A1 6/2004 Vestal
2004/0144918 A1 7/2004 Zare et al.
2004/0155187 A1 8/2004 Axelsson
2004/0159782 A1 8/2004 Park
2004/0183007 A1 9/2004 Belov et al.
2005/0006577 A1 1/2005 Fuhrer et al.
2005/0040326 A1 2/2005 Enke
2005/0103992 A1 5/2005 Yamaguchi et al.
2005/0133712 A1 6/2005 Belov et al.
2005/0151075 A1 7/2005 Brown et al.
2005/0194528 A1 9/2005 Yamaguchi et al.
2005/0242279 A1 11/2005 Verentchikov
2005/0258364 A1 11/2005 Whitehouse et al.
2006/0169882 A1 8/2006 Pau et al.
2006/0214100 A1 9/2006 Verentchikov et al.
2006/0289746 A1 12/2006 Raznikov et al.
2007/0023645 A1 2/2007 Chernushevich
2007/0029473 A1 2/2007 Verentchikov
2007/0176090 A1 8/2007 Verentchikov
2007/0187614 A1 8/2007 Schneider et al.
2007/0194223 A1 8/2007 Sato et al.
2008/0049402 A1 2/2008 Han et al.
2008/0197276 A1 8/2008 Nishiguchi et al.
2008/0203288 A1 8/2008 Makarov et al.
2008/0290269 A1 11/2008 Saito et al.
2009/0090861 A1 4/2009 Willis et al.
2009/0114808 A1 5/2009 Bateman et al.
2009/0121130 A1 5/2009 Satoh
2009/0206250 A1 8/2009 Wollnik
2009/0250607 A1 10/2009 Staats et al.
2009/0272890 A1 11/2009 Ogawa et al.
2009/0294658 A1 12/2009 Vestal et al.
2009/0314934 A1 12/2009 Brown
2010/0001180 A1 1/2010 Bateman et al.
2010/0044558 A1 2/2010 Sudakov
2010/0072363 A1 3/2010 Giles et al.
2010/0078551 A1 4/2010 Loboda
2010/0140469 A1 6/2010 Nishiguchi
2010/0193682 A1 8/2010 Golikov et al.
2010/0207023 A1 8/2010 Loboda
2010/0301202 A1 12/2010 Vestal
2011/0133073 A1 6/2011 Sato et al.
2011/0168880 A1 7/2011 Ristroph et al.
2011/0180702 A1 7/2011 Flory et al.
2011/0180705 A1 7/2011 Yamaguchi
2011/0186729 A1 8/2011 Verentchikov et al.
2012/0168618 A1 7/2012 Vestal
2012/0261570 A1 10/2012 Shvartsburg et al.
2012/0298853 A1 11/2012 Kurulugama
2013/0048852 A1 2/2013 Verenchikov
2013/0056627 A1 3/2013 Verenchikov
2013/0068942 A1 3/2013 Verenchikov
2013/0187044 A1 7/2013 Ding et al.
2013/0240725 A1 9/2013 Makarov
2013/0248702 A1 9/2013 Makarov
2013/0256524 A1 10/2013 Brown et al.
2013/0313424 A1 11/2013 Makarov et al.
2013/0327935 A1 12/2013 Wiedenbeck
2014/0054454 A1 2/2014 Hoyes et al.
2014/0054456 A1 2/2014 Kinugawa et al.
2014/0084156 A1 3/2014 Ristroph et al.
2014/0117226 A1 5/2014 Giannakopulos
2014/0138538 A1 5/2014 Hieftje et al.
2014/0183354 A1 7/2014 Moon et al.
2014/0191123 A1 7/2014 Wildgoose et al.
2014/0217275 A1 8/2014 Ding
2014/0239172 A1 8/2014 Makarov
2014/0246575 A1 9/2014 Langridge et al.
2014/0291503 A1 10/2014 Shchepunov et al.
2014/0312221 A1 10/2014 Verenchikov et al.
2014/0361162 A1 12/2014 Murray et al.
2015/0028197 A1 1/2015 Grinfeld et al.
2015/0028198 A1 1/2015 Grinfeld et al.
2015/0034814 A1 2/2015 Brown et al.
2015/0048245 A1 2/2015 Vestal et al.
2015/0060656 A1 3/2015 Ugarov
2015/0122986 A1 5/2015 Haase
2015/0144779 A1 5/2015 Verenchikov
2015/0194296 A1 7/2015 Verenchikov et al.
2015/0228467 A1 8/2015 Grinfeld et al.

(56) References Cited

U.S. PATENT DOCUMENTS

| | | | | |
|---|---|---|---|---|
| 2015/0270115 | A1 | 9/2015 | Furuhashi | |
| 2015/0279650 | A1 | 10/2015 | Verenchikov | |
| 2015/0318156 | A1 | 11/2015 | Loyd et al. | |
| 2015/0364309 | A1 | 12/2015 | Welkie | |
| 2015/0380206 | A1* | 12/2015 | White | H01J 37/1472 250/396 R |
| 2015/0380233 | A1 | 12/2015 | Verenchikov | |
| 2016/0005587 | A1 | 1/2016 | Verenchikov | |
| 2016/0035552 | A1 | 2/2016 | Verenchikov | |
| 2016/0035558 | A1 | 2/2016 | Verenchikov et al. | |
| 2016/0079052 | A1 | 3/2016 | Makarov et al. | |
| 2016/0225598 | A1 | 8/2016 | Ristroph | |
| 2016/0225602 | A1 | 8/2016 | Ristroph et al. | |
| 2016/0240363 | A1 | 8/2016 | Verenchikov | |
| 2017/0016863 | A1 | 1/2017 | Verenchikov | |
| 2017/0025265 | A1 | 1/2017 | Verenchikov et al. | |
| 2017/0032952 | A1 | 2/2017 | Verenchikov | |
| 2017/0098533 | A1 | 4/2017 | Stewart et al. | |
| 2017/0168031 | A1 | 6/2017 | Verenchikov | |
| 2017/0169633 | A1 | 6/2017 | Leung et al. | |
| 2017/0229297 | A1 | 8/2017 | Green et al. | |
| 2017/0338094 | A1 | 11/2017 | Verenchikov et al. | |
| 2018/0144921 | A1 | 5/2018 | Hoyes et al. | |
| 2018/0315589 | A1 | 11/2018 | Oshiro | |
| 2018/0330936 | A1* | 11/2018 | Hoyes | H01J 49/10 |
| 2018/0366312 | A1 | 12/2018 | Grinfeld et al. | |
| 2018/0366313 | A1* | 12/2018 | Hoyes | H01J 49/401 |
| 2019/0180998 | A1 | 6/2019 | Stewart et al. | |
| 2019/0206669 | A1 | 7/2019 | Verenchikov et al. | |
| 2019/0237318 | A1 | 8/2019 | Brown | |
| 2019/0360981 | A1 | 11/2019 | Verenchikov | |
| 2020/0083034 | A1 | 3/2020 | Verenchikov et al. | |
| 2020/0090919 | A1 | 3/2020 | Artaev | |
| 2020/0126781 | A1 | 4/2020 | Kovtoun | |
| 2020/0152440 | A1 | 5/2020 | Hoyes et al. | |
| 2020/0168447 | A1 | 5/2020 | Verenchikov | |
| 2020/0168448 | A1 | 5/2020 | Verenchikov | |
| 2020/0243322 | A1 | 7/2020 | Stewart et al. | |
| 2020/0373142 | A1 | 11/2020 | Verenchikov | |
| 2020/0373143 | A1 | 11/2020 | Verenchikov et al. | |
| 2020/0373145 | A1 | 11/2020 | Verenchikov et al. | |

FOREIGN PATENT DOCUMENTS

| | | | |
|---|---|---|---|
| CN | 102131563 | A | 7/2011 |
| CN | 201946564 | U | 8/2011 |
| CN | 103270574 | A | 8/2013 |
| CN | 103684817 | A | 3/2014 |
| CN | 206955673 | U | 2/2018 |
| DE | 4310106 | C1 | 10/1994 |
| DE | 10116536 | A1 | 10/2002 |
| DE | 102015121830 | A1 | 6/2017 |
| DE | 102019129108 | A1 | 6/2020 |
| DE | 112015001542 | B4 | 7/2020 |
| EP | 0237259 | A2 | 9/1987 |
| EP | 1137044 | A2 | 9/2001 |
| EP | 1566828 | A2 | 8/2005 |
| EP | 1901332 | A1 | 3/2008 |
| EP | 2068346 | A2 | 6/2009 |
| EP | 1665326 | B1 | 4/2010 |
| EP | 1522087 | B1 | 3/2011 |
| EP | 2599104 | A1 | 6/2013 |
| EP | 1743354 | B1 | 8/2019 |
| EP | 3662501 | A1 | 6/2020 |
| EP | 3662502 | A1 | 6/2020 |
| EP | 3662503 | A1 | 6/2020 |
| GB | 2080021 | A | 1/1982 |
| GB | 2217907 | A | 11/1989 |
| GB | 2274197 | A | 7/1994 |
| GB | 2300296 | A | 10/1996 |
| GB | 2390935 | A | 1/2004 |
| GB | 2396742 | A | 6/2004 |
| GB | 2403063 | A | 12/2004 |
| GB | 2455977 | A | 7/2009 |
| GB | 2476964 | A | 7/2011 |
| GB | 2478300 | A | 9/2011 |
| GB | 2484361 | B | 4/2012 |
| GB | 2484429 | B | 4/2012 |
| GB | 2485825 | A | 5/2012 |
| GB | 2489094 | A | 9/2012 |
| GB | 2490571 | A | 11/2012 |
| GB | 2495127 | A | 4/2013 |
| GB | 2495221 | A | 4/2013 |
| GB | 2496991 | A | 5/2013 |
| GB | 2496994 | A | 5/2013 |
| GB | 2500743 | A | 10/2013 |
| GB | 2501332 | A | 10/2013 |
| GB | 2506362 | A | 4/2014 |
| GB | 2528875 | A | 2/2016 |
| GB | 2555609 | A | 5/2018 |
| GB | 2556451 | A | 5/2018 |
| GB | 2556830 | A | 6/2018 |
| GB | 2562990 | A | 12/2018 |
| GB | 2575157 | A | 1/2020 |
| GB | 2575339 | A | 1/2020 |
| JP | S6229049 | A | 2/1987 |
| JP | 2000036285 | A | 2/2000 |
| JP | 2000048764 | A | 2/2000 |
| JP | 2003031178 | A | 1/2003 |
| JP | 3571546 | B2 | 9/2004 |
| JP | 2005538346 | A | 12/2005 |
| JP | 2006049273 | A | 2/2006 |
| JP | 2007227042 | A | 9/2007 |
| JP | 2010062152 | A | 3/2010 |
| JP | 4649234 | B2 | 3/2011 |
| JP | 2011119279 | A | 6/2011 |
| JP | 4806214 | B2 | 11/2011 |
| JP | 2013539590 | A | 10/2013 |
| JP | 5555582 | B2 | 7/2014 |
| JP | 2015506567 | B2 | 3/2015 |
| JP | 2015185306 | A | 10/2015 |
| RU | 2564443 | C2 | 10/2015 |
| RU | 2015148627 | A | 5/2017 |
| SU | 198034 | | 6/1967 |
| SU | 1681340 | A1 | 9/1991 |
| SU | 1725289 | A1 | 4/1992 |
| WO | 9103071 | A1 | 3/1991 |
| WO | 1998001218 | | 1/1998 |
| WO | 1998008244 | A2 | 2/1998 |
| WO | 200077823 | A2 | 12/2000 |
| WO | 2005001878 | A2 | 1/2005 |
| WO | 2005043575 | A2 | 5/2005 |
| WO | 2006014984 | A1 | 2/2006 |
| WO | 2006049623 | A2 | 5/2006 |
| WO | 2006102430 | A2 | 9/2006 |
| WO | 2006103448 | A2 | 10/2006 |
| WO | 2007044696 | A1 | 4/2007 |
| WO | 2007104992 | A2 | 9/2007 |
| WO | 2007136373 | A1 | 11/2007 |
| WO | 2008046594 | A2 | 4/2008 |
| WO | 2008087389 | A2 | 7/2008 |
| WO | 2010008386 | A1 | 1/2010 |
| WO | 2010138781 | A2 | 12/2010 |
| WO | 2011086430 | A1 | 7/2011 |
| WO | 2011107836 | A1 | 9/2011 |
| WO | 2011135477 | A1 | 11/2011 |
| WO | 2012010894 | A1 | 1/2012 |
| WO | 2012013354 | A1 | 2/2012 |
| WO | 2012023031 | A2 | 2/2012 |
| WO | 2012024468 | A2 | 2/2012 |
| WO | 2012024570 | A2 | 2/2012 |
| WO | 2012116765 | A1 | 9/2012 |
| WO | 2013045428 | A1 | 4/2013 |
| WO | 2013063587 | A2 | 5/2013 |
| WO | 2013067366 | A2 | 5/2013 |
| WO | 2013098612 | A1 | 7/2013 |
| WO | 2013110587 | A | 8/2013 |
| WO | 2013110588 | A2 | 8/2013 |
| WO | 2013124207 | A | 8/2013 |
| WO | 2014021960 | A1 | 2/2014 |
| WO | 2014074822 | A1 | 5/2014 |
| WO | 2014110697 | A | 7/2014 |
| WO | 2014142897 | A1 | 9/2014 |

(56) References Cited

FOREIGN PATENT DOCUMENTS

| | | | |
|---|---|---|---|
| WO | 2014152902 | A2 | 9/2014 |
| WO | 2015142897 | A1 | 9/2015 |
| WO | 2015152968 | A1 | 10/2015 |
| WO | 2015153622 | A1 | 10/2015 |
| WO | 2015153630 | A1 | 10/2015 |
| WO | 2015153644 | A1 | 10/2015 |
| WO | 2015175988 | A1 | 11/2015 |
| WO | 2015189544 | A1 | 12/2015 |
| WO | 2016064398 | A1 | 4/2016 |
| WO | 2016174462 | A1 | 11/2016 |
| WO | 2016178029 | A1 | 11/2016 |
| WO | 2017042665 | A1 | 3/2017 |
| WO | 2018073589 | A1 | 4/2018 |
| WO | 2018109920 | A1 | 6/2018 |
| WO | 2018124861 | A2 | 7/2018 |
| WO | 2018183201 | A1 | 10/2018 |
| WO | 2019030472 | A1 | 2/2019 |
| WO | 2019030474 | A1 | 2/2019 |
| WO | 2019030475 | A1 | 2/2019 |
| WO | 2019030476 | A1 | 2/2019 |
| WO | 2019030477 | A1 | 2/2019 |
| WO | 2019058226 | A1 | 3/2019 |
| WO | 2019162687 | A1 | 8/2019 |
| WO | 2019202338 | A1 | 10/2019 |
| WO | 2019229599 | A1 | 12/2019 |
| WO | 2020002940 | A1 | 1/2020 |
| WO | 2020021255 | A1 | 1/2020 |
| WO | 2020121167 | A1 | 6/2020 |
| WO | 2020121168 | A1 | 6/2020 |

OTHER PUBLICATIONS

International Search Report and Written Opinion for International Application No. PCT/GB2020/050471, dated May 13, 2020.
Search Report for GB Application No. GB2002768.6 dated Jul. 7, 2020.
Search Report for GB Application No. GB 1903779.5, dated Sep. 20, 2019.
International Search Report and Written Opinion for International Application No. PCT/US2016/062174 dated Mar. 3, 2017, 8 pages.
IPRP PCT/US2016/062174 dated May 22, 2018, 6 pages.
Search Report for GB Application No. GB1520130.4 dated May 25, 2016.
International Search Report and Written Opinion for International Application No. PCT/US2016/062203 dated Mar. 3, 2017, 8 pages.
dated PCT/US2016/062203, dated May 22, 2018, 6 pages.
Search Report for GB Application No. GB1520134.6 dated May 26, 2016.
Search Report Under Section 17(5) for Application No. GB1507363.8 dated Nov. 9, 2015.
International Search Report and Written Opinion of the International Search Authority for Application No. PCT/GB2016/051238 dated Jul. 12, 2016, 16 pages.
IPRP for application PCT/GB2016/051238 dated Oct. 31, 2017, 13 pages.
International Search Report and Written Opinion for International Application No. PCT/US2016/063076 dated Mar. 30, 2017, 9 pages.
IPRP for application PCT/US2016/063076, dated May 29, 2018, 7 pages.
Search Report for GB Application No. 1520540.4 dated May 24, 2016.
IPRP PCT/GB17/51981 dated Jan. 8, 2019, 7 pages.
IPRP for International application No. PCT/GB2018/051206, dated Nov. 5, 2019, 7 pages.
International Search Report and Written Opinion for International Application No. PCT/GB2018/051206, dated Jul. 12, 2018, 9 pages.
Examination Report under Section 18(3) for Application No. GB1906258.7, dated May 5, 2021, 4 pages.
Author unknown,"Electrostatic lens ," Wikipedia, Mar. 31, 2017 (Mar. 31, 2017), XP055518392, Retrieved from the Internet:URL: https://en.wikipedia.org/w/index.php?title=Electrostatic_lens&oldid=773161674 [retrieved on Oct. 24, 2018].
Hussein, O.A et al., "Study the most favorable shapes of electrostatic quadrupole doublet lenses", AIP Conference Proceedings, vol. 1815, Feb. 17, 2017 (Feb. 17, 2017), p. 110003.
Guan S., et al. "Stacked-ring electrostatic ion guide" Journal of the American Society for Mass Spectrometry, Elsevier Science Inc, 7(1):101-106 (1996). ABSTRACT.
International Search Report and Written Opinion for application No. PCT/GB2018/052104, dated Oct. 31, 2018, 14 pages.
International Search Report and Written Opinion for application No. PCT/GB2018/052105, dated Oct. 15, 2018, 18 pages.
International Search Report and Written Opinion for application PCT/GB2018/052100, dated Oct. 19, 2018, 19 pages.
International Search Report and Written Opinion for application PCT/GB2018/052102, dated Oct. 25, 2018, 14 pages.
International Search Report and Written Opinion for application No. PCT/GB2018/052099, dated Oct. 10, 2018, 16 pages.
International Search Report and Written Opinion for application No. PCT/GB2018/052101, dated Oct. 19, 2018, 15 pages.
Combined Search and Examination Report under Sections 17 and 18(3) for application GB1807605.9 dated Oct. 29, 2018, 5 pages.
Combined Search and Examination Report under Sections 17 and 18(3) for application GB1807626.5, dated Oct. 29, 2018, 7 pages.
Yavor, M.I., et al., "High performance gridless ion mirrors for multi-reflection time-of-flight and electrostatic trap mass analyzers", International Journal of Mass Spectrometry, vol. 426, Mar. 2018, pp. 1-11.
Search Report under Section 17(5) for application GB1707208.3, dated Oct. 12, 2017, 5 pages.
Communication Relating to the Results of the Partial International Search for International Application No. PCT/GB2019/01118, dated Jul. 19, 2019, 25 pages.
Doroshenko, V.M., and Cotter, R.J., "Ideal velocity focusing in a reflectron time-of-flight mass spectrometer", American Society for Mass Spectrometry, 10(10):992-999 (1999).
Kozlov, B et al. "Enhanced Mass Accuracy in Multi-Reflecting TOF MS" www.waters.com/posters, ASMS Conference (2017).
Kozlov, B. et al. "Multiplexed Operation of an Orthogonal Multi-Reflecting TOF Instrument to Increase Duty Cycle by Two Orders" ASMS Conference, San Diego, CA, Jun. 6, 2018.
Kozlov, B et al. "High accuracy self-calibration method for high resolution mass spectra" ASMS Conference Abstract, 2019.
Kozlov, B. et al. "Fast Ion Mobility Spectrometry and High Resolution TOF MS" ASMS Conference Poster (2014).
Verenchicov., A. N. "Parallel MS-MS Analysis in a Time-Flight Tandem. Problem Statement, Method, and nstrucmental Schemes" Institute for Analytical Instrucmentation RAS, Saint-Petersburg, (2004) ABSTRACT.
Yavor, M. I. "Planar Multireflection Time-Of-Flight Mass Analyser with Unlimited Mass Range" Institute for Analytical Instrucmentation RAS, Saint-Petersburg, (2004) ABSTRACT.
Khasin, Y. I. et al. "Initial Experimenatl Studies of a Planar Multireflection Time-Of-Flight Mass Spectrometer" Institute for Analytical Instrucmentation RAS, Saint-Petersburg, (2004) ABSTRACT.
Verenchicov., A. N. et al. "Stability of Ion Motion in Periodic Electrostatic Fields" Institute for Analytical Instrucmentation RAS, Saint-Petersburg, (2004) ABSTRACT.
Verenchicov., A. N. "The Concept of Multireflecting Mass Spectrometer for Continuous Ion Sources" Institute for Analytical Instrucmentation RAS, Saint-Petersburg, (2006) ABSTRACT.
Verenchicov., A. N., et al. "Accurate Mass Measurements for Inerpreting Spectra of atmospheric Pressure Ionization" Institute for Analytical Instrucmentation RAS, Saint-Petersburg, (2006) ABSTRACT.
Kozlov, B. N. et al., "Experimental Studies of Space Charge Effects in Multireflecting Time-Of-Flight Mass Spectrometes" Institute for Analytical Instrucmentation RAS, Saint-Petersburg, (2006) ABSTRACT.
Kozlov, B. N. et al., "Multireflecting Time-Of-Flight Mass Spectrometer With an Ion Trap Source" Institute for Analytical Instrucmentation RAS, Saint-Petersburg, (2006) ABSTRACT.

(56) References Cited

OTHER PUBLICATIONS

Hasin, Y. I., et al.,"Planar Time-Of-Flight Multireflecting Mass Spectrometer with an Orthogonal Ion Injection Out of Continuous Ion Sources" Institute for Analytical Instrucmentation RAS, Saint-Petersburg, (2006) ABSTRACT.
Lutvinsky Y. I. et al., "Estimation of Capacity of High Resolution Mass Spectra for Analysis of Complex Mixtures" Institute for Analytical Instrucmentation RAS, Saint-Petersburg, (2006) ABSTRACT.
Verenchicov., A. N. et al. "Multiplexing in Multi-Reflecting TOF MS" Journal of Applied Solution Chemistry and Modeling, 6:1-22 (2017).
Supplementary Partial EP Search Report for EP Application No. 16869126.9, dated Jun. 13, 2019.
Supplementary Partial EP Search Report for EP Application No. 16866997.6, dated Jun. 7, 2019.
"Reflectron—Wikipedia", Oct. 9, 2015, Retrieved from the Internet: URL:https://en.wikipedia.org/w/index.php?t itle=Reflectron&oldid-684843442 [retrieved on May 29, 2019].
Scherer, S., et al., "A novel principle for an ion mirror design in time-of-flight mass spectrometry", International Journal of Mass Spectrometry, Elsevier Science Publishers, Amsterdam, NL, vol. 251, No. 1, Mar. 15, 2006.
International Search Report and Written Opinion for International Application No. PCT/EP2017/070508 dated Oct. 16, 2017, 17 pages.
Search Report for United Kingdom Application No. GB1613988.3 dated Jan. 5, 2017, 4 pages.
Sakurai et al., "A New Multi-Passage Time-of-Flight Mass Spectrometer at JAIST", Nuclear Instruments & Methods in Physics Research, Section A, Elsevier, 427(1-2): 182-186, May 11, 1999. Abstract.
Toyoda et al., "Multi-Turn-Time-of-Flight Mass Spectometers with Electrostatic Sectors", Journal of Mass Spectrometry, 38:1125-1142, Jan. 1, 2003.
Wouters et al., "Optical Design of the TOFI (Time-of-Flight Isochronous) Spectrometer for Mass Measurements of Exotic Nuclei", Nuclear Instruments and Methods in Physics Research, Section A, 240(1): 77-90, Oct. 1, 1985.
Stresau, D., et al.: "Ion Counting Beyond 10ghz Using a New Detector and Conventional Electronics", European Winter Conference on Plasma Spectrochemistry, Feb. 4-8, 2001, Lillehammer, Norway, Retrieved from the Internet:www.etp-ms.com/file-repository/21 [retrieved on Jul. 31, 2019].
Kaufmann, R., et al., "Sequencing of peptides in a time-of-flight mass spectrometer:evaluation of postsource decay following matrix-assisted laser desorption ionisation (MALDI)", International Journal of Mass Spectrometry and Ion Processes, Elsevier Scientific Publishing Co. Amsterdam, NL, 131:355-385, Feb. 24, 1994.
Barry Shaulis et al: "Signal linearity of an extended range pulse counting detector: Applications to accurate and precise U-Pb dating of zircon by laser ablation quadrupole ICP-MS", G3: Geochemistry, Geophysics, Geosystems, 11(11):1-12, Nov. 20, 2010.
Search Report for United Kingdom Application No. GB1708430.2 dated Nov. 28, 2017.
International Search Report and Written Opinion for International Application No. PCT/GB2018/051320 dated Aug. 1, 2018.
International Search Report and Written Opinion for International Application No. PCT/GB2019/051839 dated Sep. 18, 2019.
International Search Report and Written Opinion for International Application No. PCT/GB2019/051234 dated Jul. 29, 2019, 5 pages.
Combined Search and Examination Report for United Kingdom Application No. GB1901411.7 dated Jul. 31, 2019.
Extended European Search Report for EP Patent Application No. 16866997.6, dated Oct. 16, 2019.
Combined Search and Examination Report for GB 1906258.7, dated Oct. 25, 2019.
Combined Search and Examination Report for GB1906253.8, dated Oct. 30, 2019, 5 pages.
Search Report under Section 17(5) for GB1916445.8, dated Jun. 15, 2020.
International Search Report and Written Opinion for International application No. PCT/GB2020/050209, dated Apr. 28, 2020, 12 pages.
Author unknown, "Einzel Lens", Wikipedia [online] Nov. 2020 [retrieved on Nov. 3, 2020]. Retrieved from Internet URL: https://en.wikipedia.org/wiki/Einzel_lens, 2 pages.
International Search Report and Written Opinion for International application No. PCT/GB2019/051235, dated Sep. 25, 2019, 22 pages.
International Search Report and Written Opinion for International application No. PCT/GB2019/051416, dated Oct. 10, 2019, 22 pages.
Search and Examination Report under Sections 17 and 18(3) for Application No. GB 1906258.7, dated Dec. 11, 2020, 7 pages.
Carey, D.C., "Why a second-order magnetic optical achromat works", Nucl. Instrum. Meth., 189(203):365-367 (1981).
Yavor, M., "Optics of Charged Particle Analyzers", Advances in Imaging and Electron Physics Book Series, vol. 57 (2009) Abstract.
Sakurai, T. et al., "Ion optics for time-of-flight mass spectrometers with multiple symmetry", Int J Mass Spectrom Ion Proc 63(2-3):273-287 (1985).
Wollnik, H., "Optics of Charged Particles", Acad. Press, Orlando, FL (1987) ABSTRACT.
Wollnik, H., and Casares, A., "An energy-isochronous multi-pass time-of-flight mass spectrometer consisting of two coaxial electrostatic mirrors", Int J Mass Spectrom 227:217-222 (2003).
O'Halloran, G.J., et al., "Determination of Chemical Species Prevalent in a Plasma Jet", Bendix Corp Report ASD-TDR-62-644, U.S. Air Force (1964). ABSTRACT.
Examination Report for United Kingdom Application No. GB1618980.5 dated Jul. 25, 2019.
Communication pursuant to Article 94(3) EPC for Application No. 16867005.7, dated Jul. 1, 2021, 6 pages.
Hoyes et al., "Electrostatic gimbal for correction of errors in Time of Flight mass spectrometers", Waters, 2013.
Verentchikov, A., et al., "Stable ion beam transport through periodic electrostatic structures: linear and non-linear effects", Physics Procedia, 1 (1):87-97, Aug. 2008.

* cited by examiner

MULTI-REFLECTING TIME OF FLIGHT MASS ANALYSER

CROSS-REFERENCE TO RELATED APPLICATIONS

This application is a U.S. national phase filing claiming the benefit of and priority to International Patent Application No. PCT/GB2019/051235, filed on May 3, 2019, which claims priority from and the benefit of United Kingdom patent application No. 1807626.5 filed on May 10, 2018. The entire contents of these applications are incorporated herein by reference.

FIELD OF THE INVENTION

The present invention relates generally to Multi-Reflecting Time of Flight (MRTOF) mass analysers or mass separators, and in particular to techniques for controlling the number of ion reflections between the ion mirrors.

BACKGROUND

Time of Flight (TOF) mass analysers pulse ions into a time of flight region towards a detector. The duration of time between an ion being pulsed and being detected at the detector is used to determine the mass to charge ratio of that ion. In order to increase the resolving power of a time-of-flight mass analyser it is necessary to increase the flight path length of the ions.

Multi-reflecting TOF mass analysers are known in which ions are reflected multiple times between ion mirrors in a time of flight region, so as to provide a relatively long ion flight path to the detector. A periodic lens it provided between the ion mirrors so as to control the trajectories of the ions through the analyser so as to ensure that all ions are reflected the same number of times between the ion mirrors and hence travel the same flight path length. However, the periodic lens introduces aberrations to the ion flight times, which restricts the resolving power of the instrument. For example, positive aberrations to the ion flight time may be introduced for ions that travel close to the elements of the periodic lens ("orthogonal aberrations"), since it normally takes these ions longer to travel through the lens system. Negative orthogonal aberrations may also occur if so called immersion lens elements are used. Such immersion lens elements may be arranged in acceleration or deceleration elements of ion optics, and particularly, in ion mirrors. It is difficult to compensate for these aberrations due multiple interfering parameters.

SUMMARY

From a first aspect the present invention provides a mass spectrometer comprising: an ion energy filter arranged and configured to filter ions according to their kinetic energy and so as to only transmit ions having a component of kinetic energy in a first dimension (z-dimension) that is within a selected range; and a multi-reflecting time of flight mass analyser or mass separator having an ion accelerator, and two gridless ion mirrors that are elongated in the first dimension (z-dimension) and configured to reflect ions multiple times in a second orthogonal dimension (x-dimension), wherein the ion accelerator is arranged to receive ions from the energy filter and accelerate the ions into one of the ion mirrors.

The ion accelerator may pulse the ions into the first ion mirror as a series of ion packets and towards a detector. Ions in the different packets may be received over the same area of the detector.

The ion accelerator in a multi-reflecting time of flight (MRTOF) mass analyser or mass separator is arranged and configured for accelerating ions into a first of the ion mirrors at an angle to the second dimension (x-dimension) such that the ions are repeatedly reflected between the ion mirrors in the second dimension (x-dimension) as they drift through the mass analyser or separator in the first dimension (z-dimension). The energy filter filters out ions having kinetic energies in the first dimension that are outside of the selected/desired range. This reduces the spread of ion velocities, in the first dimension, of the ions that are received in the mass analyser or mass separator. As such, this reduces the expansion of the ion beam in the first dimension, within the mass analyser or separator, so that the ions are reflected the same number of times between the ion mirrors. This ensures that the flight path lengths that the ions travel through the mass analyser or separator are substantially the same. In the mass analyser embodiments, this may prevent ions being assigned the wrong mass to charge ratio and improves the mass resolution.

It has previously been contemplated to introduce ions into the space between the ion mirrors in an MRTOF mass spectrometer by using various ion optical devices, such as an electric sector. It is also known to perform some energy filtering of the ions. However, previously, the energy filtering has been performed to filter the ion energy in the direction between the ion mirrors (x-dimension), after the ions have already been accelerated to their time of flight energy. In contrast, the embodiments of the present invention energy filter the ions before the ions are accelerated to their time of flight energies. The energy filtered ions may therefore have a relatively low energy spread in the first dimension (z-dimension) before being accelerated to their time of flight energies by the ion accelerator, e.g. an energy spread of 0.1-1 eV. The embodiments form ions having a desired phase-volume (i.e. spread of velocities and spatial distributions) for introduction into the mass analyser or separator.

As far as the inventors are aware, it is not known to control the drift velocity/energy of the ions entering the mass analyser to be within a range such that the ions perform the same number of ion reflections between the ion mirrors.

For the avoidance of doubt, a gridless ion mirror as used herein is an ion mirror that does not have any grid electrodes arranged in the ion path within the ion mirror. The use of gridless ion mirrors enables ions to be reflected multiple times within the ion mirrors without the mirrors attenuating or scattering the ion beam, which may be particularly problematic in MRTOF instruments.

The spectrometer of the present invention may comprise a controller for controlling the energy filter so as to only onwardly transmit ions having said component of kinetic energy in the first dimension (z-dimension) within the selected range such that substantially all of these transmitted ions are reflected the same number of times, N, between the ion mirrors. The controller may control the voltages applied to electrodes of the energy filter to achieve this.

Said same number of reflections, N, may be: ≥8; ≥9; ≥10; ≥11; ≥12; ≥13; ≥14; ≥15; ≥16; ≥17; ≥18; ≥19; or ≥20.

It would not be desirable to reflect ions this many times in instruments having gridded mirrors, since the ion losses would be very large. It is known to reflect ions between gridless mirrors in an MRTOF mass analyser many times in order to provide long ion flight path lengths. However, in order to ensure that all ions undergo the same, high number of reflections, it has been necessary to provide periodic focusing of the ions in the dimension that the mirrors are elongated. In contrast, embodiments herein use the ion energy filter to ensure that the transmitted ions perform the same number of reflections.

It is contemplated that the number of reflections N may be numbers other than those described above, such as N≥5, N≥6 or N≥7.

Optionally, substantially all ions having a component of kinetic energy in a first dimension (z-dimension) that is outside of the selected range would be reflected between the mirrors a number of times other than N, were they to be transmitted into the mass analyser or mass separator.

The selected energy range that is transmitted by the energy filter into the mass analyser or mass separator is therefore as broad as possible, whilst ensuring that all transmitted ions undergo the same number of N reflections. The energy filter is therefore optimised for the configuration of the mass analyser or mass separator, whilst maintaining relatively high transmission/sensitivity.

The energy filter may be configured to only transmit ions having a kinetic energy in the first dimension (z-dimension) that is above a first threshold value; and/or the energy filter may be configured to only transmit ions having a kinetic energy in the first dimension (z-dimension) that is below a second threshold value.

The energy filter may be configured to only transmit ions having a kinetic energy spread, in the first dimension (z-dimension), that is selected from: ≤5 eV; ≤4 eV; ≤3 eV; ≤2 eV; ≤1 eV; ≤0.9 eV; ≤0.8 eV; ≤0.7 eV; ≤0.6 eV; ≤0.5 eV; ≤0.4 eV; ≤0.3 eV; ≤0.2 eV; or ≤0.1 eV.

The energy filter may comprise at least one electrostatic sector for filtering ions according to their kinetic energy. The electrostatic sector may comprise a cylindrical, spherical or toroidal shaped sector.

The energy filter may comprise an ion entrance, an ion exit, and at least two axially spaced electrodes arranged therebetween, and the energy filter may be configured to arrange a potential difference between the electrodes that urges ions in a direction from the ion exit to the ion entrance for filtering the ions according to their kinetic energy.

This allows relatively high energy ions to pass through the energy filter but not relatively low energy ions, thereby reducing the range of energies that are onwardly transmitted by the energy filter. The electrodes may be grid or mesh electrodes arranged such that the ions pass through the holes in the grid or mesh. The diameter of the ion beam received at the grid or mesh electrodes may be larger than the holes in the grid or mesh electrodes. Alternatively, the electrodes may be apertured electrodes having apertures through which the ions pass, wherein the apertures are larger than the ion beam. Other electrode arrangements are also contemplated, such as axially segmented multipole rod sets or plate electrodes, wherein different voltages are applied to the different axial segments so as to provide the potential difference.

The energy filter may be configured such that ions travel therethrough along a central axis, and the electrodes may be arranged and configured such when the potential difference is arranged between them it provides an axial potential barrier that increases as a function of radial distance from the central axis.

Alternatively, or additionally, the electrodes may be are arranged and configured such when the potential difference is arranged between them it results in curved equipotential field lines that allow ions having a first kinetic energy and travelling along a central axis of the energy filter to be onwardly transmitted by the energy filter, but deflect ions having the first kinetic energy and travelling radially outward of the central axis so as not to be onwardly transmitted by the energy filter. This arrangement helps to skim off peripheral ions and form a narrow ion beam without using diaphragms. As a result, contamination and charging of the electrode surfaces may be avoided, providing robust beam parameters.

Said electrodes may comprise a first electrode arranged towards the ion entrance, a second electrode arranged towards the ion exit, and a third electrode arranged between the first and second electrodes. The energy filter may be configured to maintain the first and second electrodes at the same potential and the third electrode at a different potential.

The energy filter herein may be configured to receive ions along an ion entrance axis that is coaxial with, parallel to, or angled to the ion exit axis of the energy filter. The ions may travel in the same direction when entering and exiting the energy filter. Alternatively, the ions may travel in different or opposite directions when entering and exiting the energy filter (e.g. in a sector energy filter).

The ion accelerator may pulse the ions into the first ion mirror as ion packets.

The ion accelerator may be an orthogonal accelerator.

The ion accelerator may be an orthogonal accelerator configured to receive ions along an ion receiving axis and accelerate those ions orthogonally to the ion receiving axis; and wherein either: (i) the ion receiving axis is parallel to the first dimension (z-dimension) and the energy filter ion exit axis is parallel to the first dimension (z-dimension); or (ii) the ion receiving axis is at an acute angle to the first dimension (z-dimension) and the energy filter ion exit axis is at an acute angle to the first dimension (z-dimension). In both cases, the ion exit axis of the energy filter may be coaxial with the ion receiving axis of the orthogonal accelerator.

The mass analyser or separator may comprise a deflection module configured to deflect the average trajectory of the ions leaving the ion accelerator towards the second dimension (x-dimension) so as to reduce the velocity component of these accelerated ions in the first dimension (z-dimension).

This enables the ions to perform a greater number of ion mirror reflections as they drift through the mass analyser or separator in the first dimension than would otherwise occur if the ion trajectory was not altered.

The deflection module may comprise two electrodes that are axially spaced in the first dimension, through which the ions pass in use, and voltage supplies connected to these electrodes so as to deflect the ions as described herein.

The ion accelerator may be an orthogonal accelerator configured to receive ions along an ion receiving axis that is arranged at an acute angle to the first dimension (z-dimension), wherein the deflection module is configured to deflect the average trajectory of the ions leaving the ion accelerator towards the second dimension (x-dimension) by said acute angle.

The may comprise an ion cooling device upstream of the energy filter for reducing the average energy of the ions received by the energy filter.

This enables the phase-volume of the ion beam to be reduced and a relatively large concentration of ions to be transmitted through the energy filter towards the mass analyser/separator, potentially increasing the duty cycle of the instrument.

The ion cooling device may be a collisional cooling cell configured to be maintained at a gas pressure such that ions collide with gas in the cell to reduce their energy.

The cooling cell may be maintained at a higher pressure than directly adjacent upstream and/or downstream regions. The cooling cell may have a dedicated gas supply of collisional gas. The cooling cell may comprise an ion guide.

Alternatively, other forms of ion cooling device may be used, such as laser cooling.

The spectrometer may be configured to accelerate ions from the ion cooling cell to the energy filter and/or from the ion cooling cell to the ion accelerator.

The mass analyser or separator may be configured such that ions are substantially not spatially focused and/or collimated in the first dimension (z-dimension) as the ions travel between the ion mirrors. Alternatively, or additionally, the mass analyser or separator may be configured such that there are substantially no aberrations due to spatial focusing in the first dimension (z-dimension) as the ions travel between the ion mirrors For example, the spectrometer may be configured such that ions are substantially not spatially focused and/or collimated in the first dimension (z-dimension) within the mass analyser or separator; or are substantially not spatially focused and/or collimated in the first dimension (z-dimension) within the mass analyser or separator after the first ion-mirror reflection.

This is in contrast to conventional MRTOF mass analysers, which include a periodic lens array between the ions mirrors for focusing ions in the first dimension (z-dimension). Embodiments of the present invention therefore avoid the time of flight aberrations associated with periodic lens arrays.

The ion accelerator may be configured to pulse ions in a series of pulses, wherein the timings of the pulses are determined by an encoding sequence that varies the duration of the time interval between adjacent pulses as the series of pulses progresses; and wherein the spectrometer comprises a processor configured to use the timings of the pulses in the encoding sequence to determine which ion data detected at a detector relate to which ion accelerator pulse so as to resolve spectral data obtained from the different ion accelerator pulses.

The ion accelerator may be configured to pulse ions towards the detector at a rate such that some of the ions pulsed towards the detector in any given pulse arrive at the detector after some of the ions that are pulsed towards the detector in a subsequent pulse.

The two ions mirrors may be configured to reflect ions over substantially the same length in the first dimension (z-dimension). This enables a relatively high number of reflections, and simplifies construction and operation of the instrument.

The mass analyser or mass separator may comprise an ion accelerator for accelerating ions into one of the ion mirrors and that is arranged between the ion mirrors; and/or may comprise an ion detector for detecting ions after having been reflected by the ion mirrors and that is arranged between the ion mirrors.

The arrangement of the ion accelerator and/or detector between the ion mirrors enables the effect of the fringe fields of the ion mirrors on the ions to be avoided.

The ion accelerator and/or detector may be arranged substantially midway, in the second dimension (x-dimension) between the ion mirrors. This may facilitate the use of simple ion mirrors. For example, the ions mirrors may be substantially symmetrical about a plane defined by the first dimension and a third dimension that is orthogonal to the first and second dimensions (i.e. the y-z plane).

To minimize aberrations due to the spread of ions in the first dimension (z-dimension), the gridless mirrors may not vary in size or electrical potential along the first dimension, except for at the edges of the mirror (in the first dimension).

The means for directing the ions into the mirror (e.g. the ion accelerator) may be arranged so that the first point of ion entry into either ion mirror is spaced from the leading edge of that ion mirror, in the first dimension, such that all ions travelling through the mirror have the same conditions independent of their coordinate in the first dimension.

Alternatively, or additionally, the means for receiving the ions from the mirrors (e.g. the detector) may be arranged so that the final point of ion exit from either ion mirror is spaced from the trailing edge of that ion mirror, in the first dimension, such that all ions travelling through the mirror have the same conditions independent of their coordinate in the first dimension.

For example, the mass analyser or mass separator may be configured such that the first point of ion entry into either ion mirror is at a distance from both ends of that ion mirror, in the first dimension (z-dimension), that is greater than 2H, where H is the largest internal dimension of the ion mirror in a third dimension (y-dimension) that is orthogonal to the first and second dimensions. The final point that the ions exit either mirror may also be a distance from both ends of that ion mirror, in the first dimension (z-dimension), that is greater than 2H.

The ion mirrors may have translation symmetry along first dimension (z-dimension), i.e. no changes in size between the points at which the ions first enter and finally exit the ion mirror. This helps avoid perturbations in first-dimension.

The mass analyser or separator may be housed in a housing and the spectrometer may further comprise an ion source, and/or at least one ion manipulation device, mounted to or arranged adjacent a wall of the housing. The spectrometer may be configured to transmit ions from the ion source, and/or through the at least one ion manipulation device, in a first direction and then turn the ions in a second, opposite direction and into the mass analyser or separator.

This arrangement allows the spectrometer to have a compact design.

The housing may be a vacuum chamber in which the mass analyser or separator is arranged.

The wall may be arranged in a plane defined by the first and second dimensions (X-Z plane).

The first and second opposite directions may be in the z-dimension and/or in a plane defined by the first and second dimensions (X-Z plane).

The at least one ion manipulation device may be any at least one, or any number, of the following devices: an ion guide; a mass filter, such as a quadrupole mass filter; an ion mobility separator; an ion trap; a fragmentation device, such as a CID collision cell; a/the cooling cell for reducing the energy spread of the ions; an ion lens; or an ion acceleration device.

The at least one ion manipulation device may comprise one or more vacuum chamber that is mounted to or arranged adjacent the wall of the housing.

The energy filter may perform the function of turning the ions in the second, opposite direction and into the mass analyser or separator. For example, an energy filter comprising one or more electrostatic sector may be used to do perform this. However, it is contemplated that any other means may be used, such as one or more curved multipoles, one or more curved collision cell, or one or more sets of deflection means (with and without energy-filtering properties).

The mass analyser described herein may comprise a time of flight ion detector.

The above-described compact arrangement of the mass spectrometer is considered to be novel in its own right.

Accordingly, from a second aspect the present invention provides a mass spectrometer comprising: a multi-reflecting time of flight mass analyser or mass separator having an ion accelerator, and two ion mirrors that are elongated in a first dimension (z-dimension) and configured to reflect ions multiple times in a second orthogonal dimension (x-dimension), wherein the mass analyser or separator is housed in a housing; and an ion source, and/or at least one ion manipulation device, mounted to or arranged adjacent a wall of the housing; wherein the spectrometer is configured to transmit ions from the ion source, and/or through the at least one ion manipulation device, in a first direction and then turn the ions in a second, opposite direction and into the mass analyser or separator.

The spectrometer of the second aspect may have any of the features described in relation to the first aspect of the invention, except that the spectrometer need not necessarily include the energy filter.

For example, the housing may be a vacuum chamber in which the mass analyser or separator is arranged.

The wall may be arranged in a plane defined by the first and second dimensions (X-Z plane).

The first and second opposite directions may be in the z-dimension and/or in a plane defined by the first and second dimensions (X-Z plane).

The at least one ion manipulation device may be any at least one, or any number, of the following devices: an ion guide; a mass filter, such as a quadrupole mass filter; an ion mobility separator; an ion trap; a fragmentation device, such as a CID collision cell; a/the cooling cell for reducing the energy spread of the ions; an ion lens; or an ion acceleration device.

The at least one ion manipulation device may comprise one or more vacuum chamber that is mounted to or arranged adjacent the wall of the housing.

Any means may be used to turn the ions in said second, opposite direction and into the mass analyser or separator. For example, one or more curved multipoles, one or more curved collision cell, or one or more sets of deflection means (with and without energy-filtering properties) may be used.

It is contemplated that the time of flight mass analyser or mass separator need not necessarily be a multi-reflecting time of flight mass analyser or mass separator and that the mass analyser or separator may have a single ion mirror, whilst still providing the above-described compact arrangement.

The first aspect of the present invention also provides a method of mass spectrometry comprising: providing a spectrometer as described herein above; controlling the ion energy filter to filter ions according to their kinetic energy and so as to only transmit ions having a component of kinetic energy in a first dimension (z-dimension) that is within a selected range; accelerating the transmitted ions into one of the ion mirrors using the ion accelerator; and reflecting the ions between the ion mirrors multiple times.

The method may comprise selecting a desired number of reflections of the ions between the ion mirrors, and then controlling the ion energy filter to filter ions so as to only transmit ions having a component of kinetic energy in a first dimension (z-dimension) that provides the selected number of reflections.

The second aspect of the present invention also provides a method of mass spectrometry comprising: providing a spectrometer as described above; and transmitting ions from the ion source, and/or through the at least one ion manipulation device, in a first direction and then turning the ions in a second, opposite direction and into the mass analyser or separator.

The method may comprise accelerating the transmitted ions into one of the ion mirrors using the ion accelerator, and reflecting the ions between the ion mirrors multiple times.

BRIEF DESCRIPTION OF THE DRAWINGS

Various embodiments will now be described, by way of example only, and with reference to the accompanying drawings in which.

DETAILED DESCRIPTION

Figure 1:
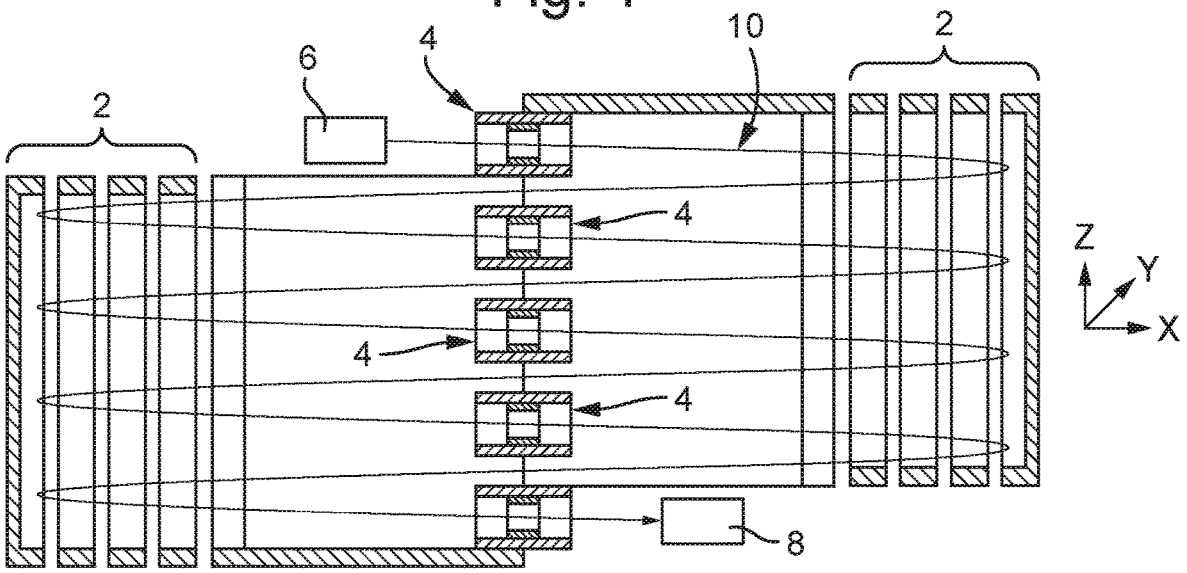
FIG. 1 shows a prior art MRTOF mass analyser.

FIG. 1 shows a known Multi-Reflecting TOF (MRTOF) mass spectrometer. The instrument comprises two ion mirrors 2 that are separated in the x-dimension by a field-free region. Each ion mirror 2 comprises multiple electrodes for reflecting ions in the x-dimension, and is elongated in the z-dimension. An array of periodic lenses 4 is arranged in the field-free region between the ion mirrors 2. An orthogonal ion accelerator 6 is arranged at one end of the analyser and an ion detector 8 is arranged at the other end of the analyser (in the z-dimension).

In use, an ion source delivers ions to the orthogonal ion accelerator 6, which accelerates packets of ions 10 into a first of the ion mirrors at an inclination angle to the x-axis. The ions therefore have a velocity in the x-dimension and also a drift velocity in the z-dimension. The ions enter into the first ion mirror and are reflected back towards the second of the ion mirrors. The ions then enter the second mirror and are reflected back to the first ion mirror. The first ion mirror then reflects the ions back to the second ion mirror. This continues and the ions are continually reflected between the two ion mirrors as they drift along the device in the z-dimension until the ions impact upon ion detector 8. The ions therefore follow a substantially sinusoidal mean trajectory within the x-z plane between the ion source and the ion detector 8.

The periodic lens array 4 is arranged such that the ion packets 10 pass through them as they are reflected between the ion mirrors 2. Voltages are applied to the electrodes of the periodic lens array 4 so as to spatially focus the ion packets in the z-dimension. This prevents the ion packets from diverging excessively in the z-dimension, which would otherwise result in some ions reaching the detector 8 having only been reflected a certain number of times and other ions reaching the detector having been reflected a larger number of times. The periodic lens array 4 therefore prevents ions have significantly different flight path lengths through the mass analyser on the way to the detector 8.

The inventors have recognised that ions may be prevented from performing different numbers of reflections between the ion mirrors by other means and without necessarily using a periodic lens between the ion mirrors, the use of which may cause aberrations in the ion flight time.

Ions may be conditioned upstream of MRTOF mass analysers by being collided with background gas in a gas-filled RF ion guide so as to collisionally cool them. The phase volume of the ion beam may be reduced to tens of milli-electron volts, including the axial movement of ions. This is five orders of magnitude lower than the typical drift energy of ions in TOF mass analysers (which is in the keV range). If this energy spread could be maintained it would be possible, for example, to provide only 6 mm of ion beam expansion for 10 m of travel in the drift direction. However, the inventors have recognised that the axial velocity spread of the ions is increased, during acceleration of the ions, by ion collisions at the exit of the collisional cooling ion guide and that this results in an increased energy spread of the ions that causes the above-described problem of ions diverging in the MRTOF mass analyser.

Figure 2:
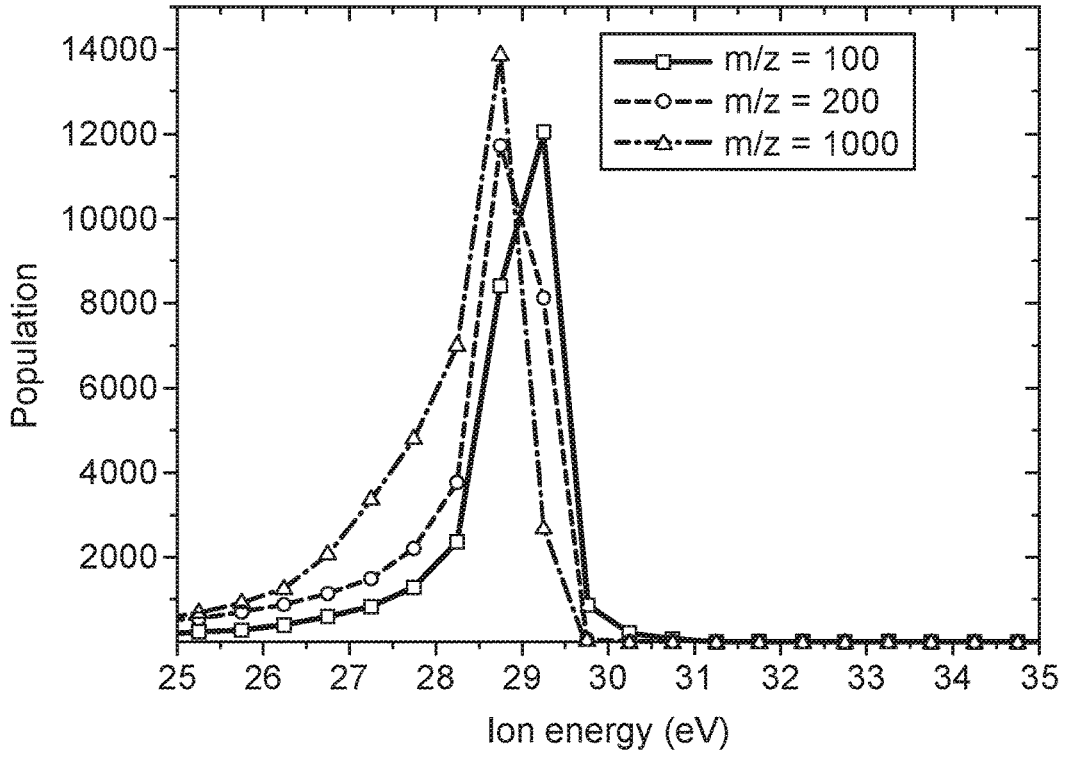
FIG. 2 shows examples of energy distributions of ions of three mass to charge ratios accelerated by a 30 V voltage after cooling in a collision cell.

FIG. 2 shows examples of energy distributions of ions of three mass to charge ratios (100, 200 and 1000) after having been collisionally cooled and accelerated by a potential difference (that would result in ions having an energy of 30 eV if there was no background gas). It can be seen that the ions have been decelerated by collisions with gas so has to have different energies spanning significant ranges, and also that ions of different mass to charge ratio have different energy distributions.

The inventors have recognised that the ion beam may be conditioned prior to entering the mass analyser such that the ions can be reflected between the ions mirrors a reasonably high number of times without different ions performing different numbers of reflections in the time of flight region. More specifically, this may be achieved by decreasing the energy spread, or decreasing the velocity spread, of the ions prior to the ions entering the mass analyser. Referring to FIG. 2 as an example, this may be achieved by preventing ions in the low energy tail of the energy distributions from entering the mass analyser. Any type of energy filter may be used for this purpose, although a number of examples will be discussed below.

Figure 3:
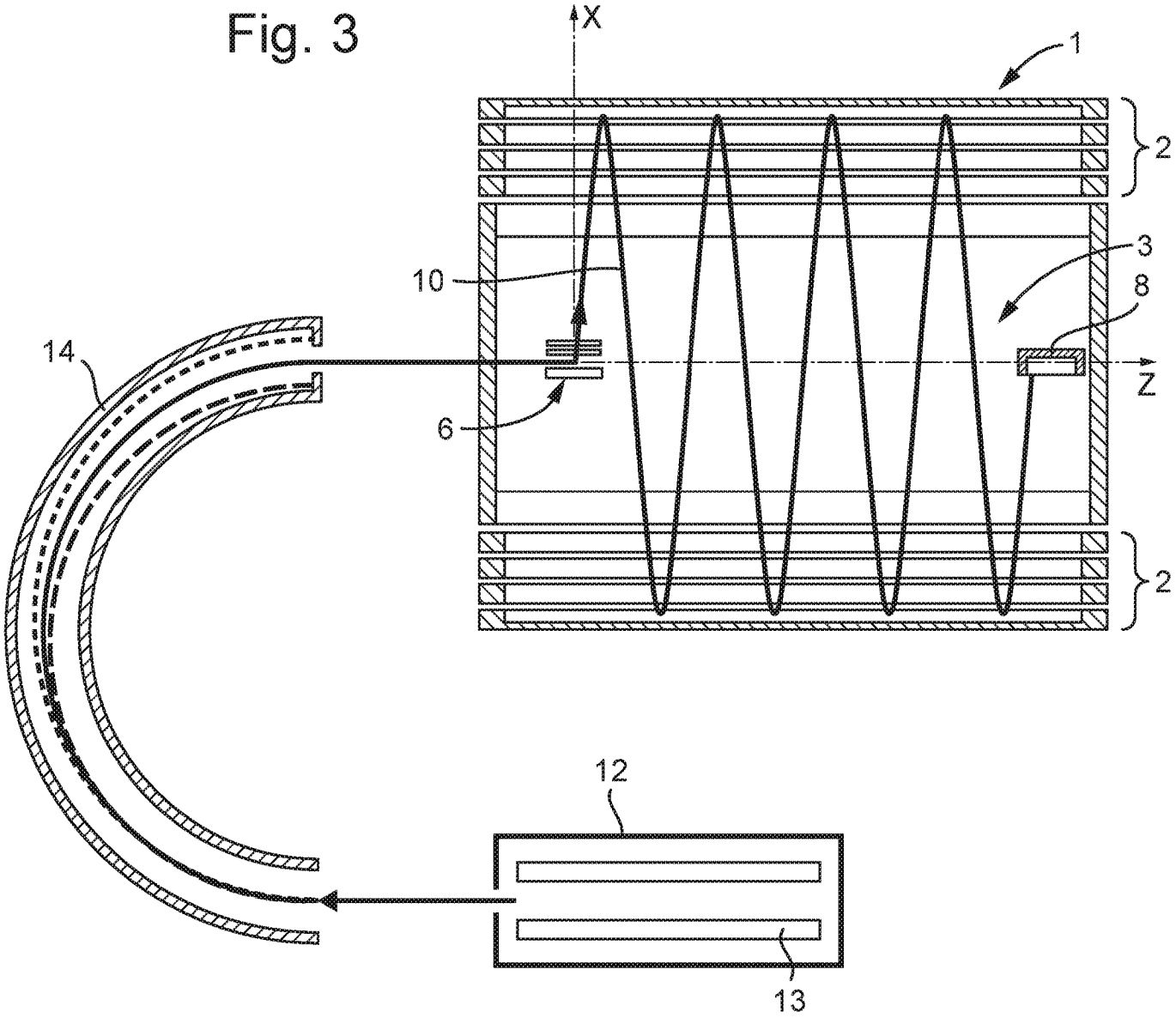
FIG. 3 shows a schematic of part of an MRTOF mass spectrometer according to an embodiment of the present invention having an electrostatic sector energy filter.

FIG. 3 shows a schematic of part of an MRTOF mass spectrometer according to an embodiment of the present invention. The instrument comprises two ion mirrors 2 that are separated in the x-dimension by a field-free region 3. Each ion mirror 2 comprises multiple electrodes so that different voltages may be applied to the electrodes to cause the ions to be reflected in the x-dimension. The electrodes are elongated in the z-dimension, which allows the ions to be reflected multiple times by each mirror 2 as they pass through the device, as will be described in more detail below. Each ion mirror 2 may form a two-dimensional electrostatic field in the X-Y plane. The drift space 3 arranged between the ion mirrors 2 may be substantially electric field-free such that when the ions are reflected and travel in the space between the ion mirrors 2 they travel through a substantially field-free region 3. An orthogonal ion accelerator 6 is arranged at one end of the mass analyser and an ion detector 8 is arranged at the other end of the analyser (in the z-dimension). The instrument also comprises a collisional cooling cell 12 and an energy filter 14 upstream of the MRTOF mass analyser. In the depicted embodiment the energy filter 14 is in the form of an electrostatic sector having an entrance for receiving ions and a slotted exit for transmitting ions of the desired energy. The collisional cooling cell 12 may comprise an ion guide 13 for radially confining ions and optionally for urging ions through the collisional cooling cell 12.

In use, the collisional cooling cell 12 is supplied with gas and ions are supplied to the collisional cooling cell 12. The ions collide with the gas in the cell 12 so as to transfer their kinetic energy to the gas molecules, thus reducing the energy of the ions and reducing their energy spread. The ions are then transferred from the collisional cooling cell 12 into the electrostatic sector energy filter 14. The ions may be supplied to the entrance of the energy filter 14 in an intermittent or pulsed manner, or continuously. The ions may be accelerated from the collisional cooling cell 12 to the electrostatic sector energy filter 14. As described above, the energy distribution range that the ions have may broaden during this transfer process. Voltages are applied to the electrodes of the electrostatic sector energy filter 14 such that only ions having axial energies in the desired energy range are capable of being transmitted from the entrance to the exit slot. The ions pass into the entrance and experience a force orthogonal to their direction of travel, due to the voltages applied to the electrostatic sector 14. The flight paths of ions having energies within the desired range of energies are bent such that these ions travel through the electrostatic sector 14 and out of the slotted exit so as to be onwardly transmitted to the MRTOF mass analyser. The flight paths of ions having energies outside of the desired range of energies are bent such that these ions impact on the internal walls of the electrostatic sector 14 and do not pass out of the exit, and are therefore not onwardly transmitted to the MRTOF mass analyser.

Ions that are transmitted by the energy filter 14 are received in the MRTOF mass analyser and pass into the orthogonal accelerator 6 along a first axis (e.g. extending in the z-dimension). This allows the duty cycle of the instrument to remain high. The orthogonal accelerator 6 pulses the ions (e.g. periodically) orthogonally to the first axis (i.e. pulsed in the x-dimension) such that packets of ions travel in the x-dimension towards and into a first of the ion mirrors 2. The ions retain a component of velocity in the z-dimension from that which they had when passing into the orthogonal accelerator 6. As such, ions are injected into the time of flight region 3 of the instrument at a small angle of inclination to the x-dimension, with a major velocity component in the x-dimension towards the first ion mirror 2 and a minor velocity component in the z-dimension towards the detector 8.

The ions pass into a first of the ion mirrors and are reflected back towards the second of the ion mirrors. The ions pass through the field-free region 3 between the mirrors 2 as they travel towards the second ion mirror and they separate according to their mass to charge ratios in the known manner that occurs in field-free regions. The ions then enter the second mirror and are reflected back to the first ion mirror, again passing through the field-free region 3 between the mirrors as they travel towards the first ion mirror. The first ion mirror then reflects the ions back to the second ion mirror. This continues and the ions are continually reflected between the two ion mirrors 2 as they drift along the device in the z-dimension until the ions impact upon ion detector 8. The ions therefore follow a substantially sinusoidal mean trajectory within the x-z plane between the ion source and the ion detector 8. The time that has elapsed between a given ion being pulsed from the orthogonal accelerator 6 to the time that the ion is detected may be determined and used, along with the knowledge of the flight path length, to calculate the mass to charge ratio of that ion.

The desired range of ion energies capable of being transmitted by the energy filter 14 is selected such that all ions received in the MRTOF mass analyser perform the same number of ion mirror reflections when pulsed from the orthogonal accelerator 6 to the detector 8. Although eight ion mirror reflections are shown in FIG. 3, the MRTOF mass analyser and energy filter 14 may be set so as to cause ions to undergo a different numbers of ion reflections.

Embodiments of the present invention relate to an MRTOF mass analyser having substantially no focusing of the ions, in the z-dimension, between the ion mirrors 2 (e.g. there is no periodic lens 4 for focusing the ions in the z-dimension). Rather, the expansion of each packet of ions 10 in the z-dimension as it travels from the orthogonal accelerator 6 to the detector 8 is limited by the range of energies that the ions have when they enter the mass analyser. In contrast, MR-TOF mass spectrometers have conventionally sought to obtain a very high resolution and hence require a high number of reflections between the ion mirrors 2. Therefore, conventionally it has been considered necessary to provide z-dimensional focusing using an array of periodic lenses arranged between the ion mirrors 2 to prevent the width of the ion packet diverging.

In the embodiment depicted in FIG. 3, one particular electrostatic sector energy-filter 14 is shown. However, other forms of electrostatic energy filter may be used (e.g. of cylindrical, spherical or toroidal shape).

Figure 4A:
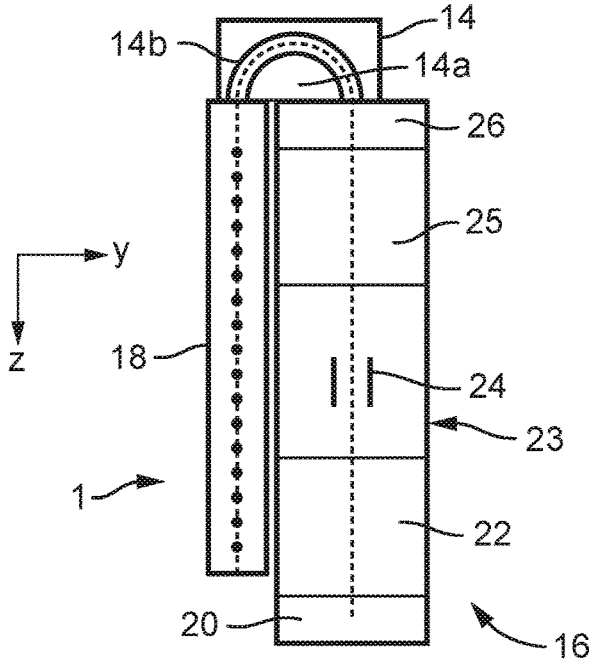
FIGS. 4A-4B show an MRTOF mass spectrometer according to another embodiment of the present invention wherein ion manipulation devices are mounted to the MRTOF mass analyser housing.
Figure 4B:
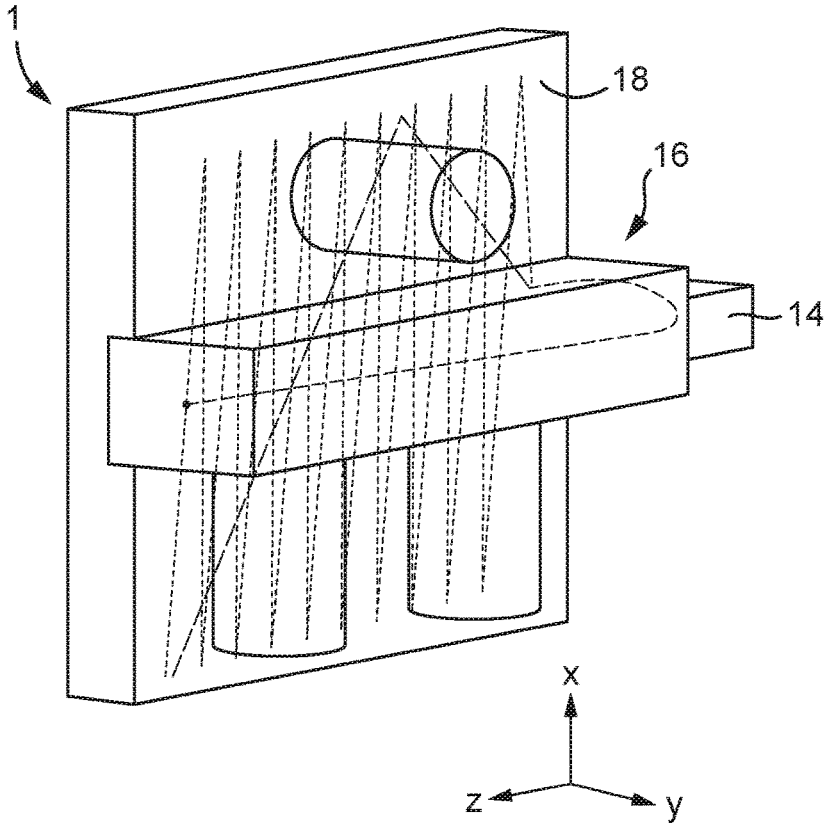

FIG. 4A shows a top-down view of an MRTOF mass spectrometer according to another embodiment of the present invention, and FIG. 4B shows a perspective view. This embodiment comprises one or more devices and/or vacuum chambers for forming and/or manipulating an ion beam 16, an energy filter 14, and an MRTOF mass analyser 1. The MRTOF mass analyser 1 is of the same form and operates in the same manner as described in relation to FIG. 3, i.e. the ions are reflected between ion mirrors 2 in the x-z plane. The MRTOF mass analyser is housed in a vacuum chamber 18 having side walls arranged substantially in the x-z plane. The one or more devices and/or vacuum chambers for forming and/or manipulating the ions 16 are located on and/or adjacent a side wall of the MRTOF mass analyser housing 18. The one or more devices and/or vacuum chambers for forming and/or manipulating the ion beam 16 may comprise an atmospheric pressure ion source, an atmospheric pressure interface 20, a first vacuum chamber 22, a second vacuum chamber 23 in which a mass filter 24 (such as a quadrupole mass filter) may be arranged, a collisional cooling cell 25 and ion optics 26. FIG. 4B shows vacuum pumps (cylinders) for pumping the vacuum chambers.

In operation, ions are formed in the atmospheric pressure ion source, such as by an ESI ion source. The ions then enter the atmospheric pressure interface 20 (which may be a tube or ion guide) and pass into the first vacuum chamber 22, which is pumped to a lower pressure than the atmospheric pressure region. The ions then pass into the second vacuum chamber 23, which may be pumped to a lower pressure than the first vacuum chamber 22 (or maintained at the same pressure). The second vacuum chamber 23 may comprise one or more devices for manipulating the ions. For example, the second vacuum chamber 23 may comprise a mass filter 24 that transmits only ions of a selected mass to charge ratio, or a selected range of mass to charge ratios. The selected mass to charge ratio(s) that is transmitted by the mass filter 24 may be controllably varied with time. Alternatively, or additionally, an ion mobility separator may be provided that separates the ions by mobility. Alternatively, or additionally, a fragmentation device (e.g. CID fragmentation cell) may be provided for fragmenting ions. For example, a mass filter and fragmentation device may be provided, wherein the mass filter selects precursor ions to fragment in the fragmentation device, and wherein the resulting fragment ions are then onwardly transmitted for analysis.

The ions are subsequently transmitted into the collisional cooling cell 25, which operates as described above in relation to FIG. 3 so as to reduce the energy spread of the ions. The collisional cooling cell 25 may comprise an axially segmented rod set, and different voltages may be applied to the different segments so that ions move through the collisional cooling cell 25 and into ion optics 26 that guide the ions into the energy filter 14. The energy filter 14 guides ions having the desired range of ion axial energies into the MRTOF mass analyser 1, as described in relation to FIG. 3, except that in the embodiment of FIG. 4 the energy filter 14 may be a cylindrical energy filter that defines an ion path between a radially inner part-cylinder electrode 14*a* and a radially outer part-cylinder electrode 14*b*. The ions then pass into the MRTOF mass analyser 1 and are analysed in the same manner as described above in relation to FIG. 3. The ions therefore travel from the ion source to the energy filter 14 along a first direction in the z-dimension, and are guided by the energy filter 14 so as to have an average direction of travel in the MRTOF analyser 1 (i.e. the drift direction) that is in a second direction opposite to the first direction. This arrangement allows the MRTOF mass analyser 1 to be mounted parallel and aside the chambers of the upstream stages 16, resulting in a relatively compact instrument.

Although an atmospheric pressure region and an atmospheric pressure ion source have been described, the region and ion source may be operated at other pressures.

Although a single sector energy filter 14 has been described that bends the ion path by 180 degrees (for ions of desired energies), other forms of energy filter may be provided. For example, the energy filter may bend the ion path (for ions of desired energies) by angles other than 180 degrees. Alternatively, or additionally, the energy filter may be formed by multiple electrostatic sectors, such as two 90 degree sectors that may have a slit arranged between them for transmitting ions of the desired energies. It is also contemplated that other forms of electrostatic energy filters may be used, as are known in the art.

Although the energy filter 14 has been described for turning the ions into the MRTOF mass analyser 1, other ion optical components may perform this function instead. For example, a curved RF ion guide such as a multipole (e.g. quadrupole) ion guide may be provided for this function. Alternatively, the ion beam may be deflected into the MRTOF mass analyser by deflection electrodes, e.g. by a two stage beam deflection device. In these embodiments, if the ion optical components for turning the ions into the MRTOF mass analyser is not configured to perform the energy filtering described herein, then a separate energy filter may be provided upstream or downstream of the ion optical components for turning the ions.

As described above, the energy filter 14 may take a form other than an electrostatic sector. Other exemplary embodiments of the energy filter will now be described below.

For example, the energy filter 14 may comprise electrodes that arrange an ion retarding potential difference (e.g. DC potential difference) that urges the ions in the opposite direction to that in which they are travelling. This may be achieved, for example, by applying different voltages to an axially spaced pair of grid/mesh electrodes, wherein the ions are arranged to travel through the holes in the grid/mesh electrodes. The ion retarding potential difference is easy to adjust and is set so as to allow relatively high energy ions to pass therethough, but to reflect or deflect relatively low energy ions so that they are not onwardly transmitted by the energy filter. Referring back to FIG. 2 as an example, this ensures that the onwardly transmitted ions have a relatively small energy distribution.

Although grid/mesh electrodes through which the ions pass have been described, other electrode arrangements may be provided, e.g. in order to reduce or avoid contamination or charging of these electrodes due ions impacting on them.

Figure 5A:
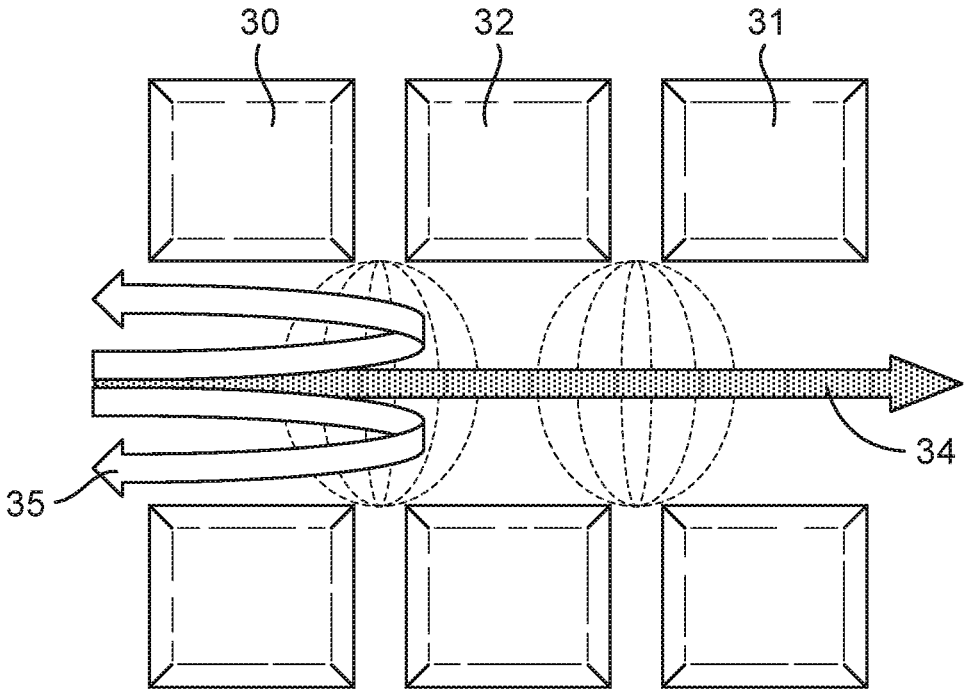
FIGS. 5A-5B show an energy filter according to an embodiment of the present invention.
Figure 5B:
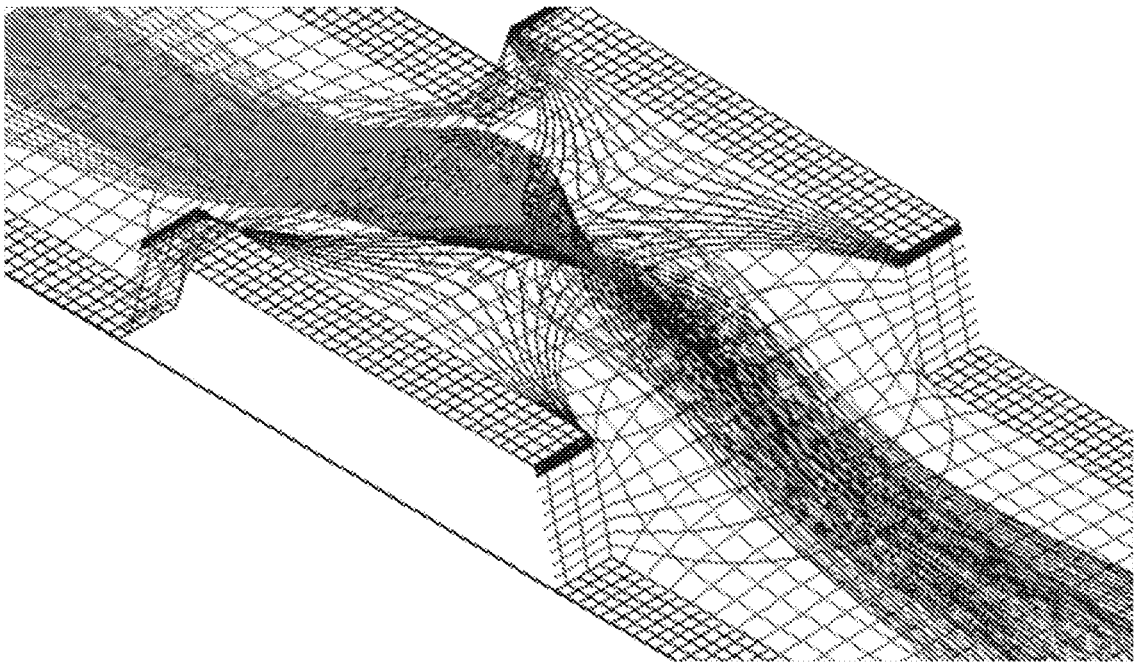

FIGS. 5A-5B show another embodiment of the energy filter. FIG. 5A shows a schematic of a cross-sectional side view of the energy filter, whereas FIG. 5B shows a Simion plot showing the ion trajectories through the energy filter. The energy filter comprises a first apertured electrode 30 disposed towards the entrance of the energy filter, a second apertured electrode 31 disposed towards the exit of the energy filter, and a third apertured electrode 32 arranged between the first and second electrodes.

In use, a beam of ions passes into the energy filter along the axis extending through the apertured electrodes 30-32. Voltages are applied to the electrodes (e.g. DC voltages) such that ions of relatively high energy are able to be transmitted through the apertures of the electrodes and out of the exit of the energy filter as shown by arrow 34, whereas ions of relatively low energy are reflected or deflected such that they are not transmitted by the energy filter as shown by arrows 35. As described above in relation to FIG. 2, this enables the energy spread of the ions transmitted by the energy filter to be reduced.

The diameter of the apertures in the electrodes 30-32 is larger than that of the ion beam and may be at least twice the diameter. The voltage applied to the third electrode 32 may be set relative to the first electrode 30 such that a decelerating electric field is arranged between the first electrode 30 and third 32 electrode. The potential on the third electrode 32 may be set according to the range of ion energies that are desired to be transmitted by the energy filter. As shown in FIG. 5B, due to penetration of the electric fields, there is a potential saddle in the centre of the aperture in the third electrode 32. As will be described below, ions that have relatively low energy or travel substantially off the central axis cannot pass through the energy filter. This allows the selection of the required phase-space in both the axial (e.g. z-dimension) and orthogonal (e.g. x- and y-dimensions) directions for incoming ion beam.

The second electrode 31 may be maintained at substantially the same voltage as the first electrode 30, such that ions which are transmitted to the exit of the energy filter have the same energy as when they enter the energy filter. In other words, the energy filter may comprise an Einzel lens. In this embodiment the ion retarding voltage applied to the third electrode 32 may be set to be substantially at the same voltage as the final electrode upstream of the energy filter (e.g. the exit of the collisional cooling cell).

The electric field lines between the adjacent apertured electrodes 30-32 are shown schematically in FIG. 5A. The electrodes may be arranged, and voltages applied to them, such that the electrodes provide electric fields that form an ion lens. Ions that have relatively low kinetic energy (i.e. undesirable ions), or that have flight paths that are substantially inclined relative to the longitudinal axis of the energy filter, will be reflected or deflected such that they do not pass through the energy filter. As can be seen from FIG. 5A, ions that pass relatively close to the electrodes 30-32 will pass through significantly curved equipotential field lines and will therefore also be deflected such that they do not pass through the energy filter. This may be used to filter out radially outer ions at the periphery of the ion beam. This may be used so as to only transmit ions at the centre of the ion beam, without necessarily having to use a collimation aperture. This is advantageous, for example, as the collimation of intense low energy ion beams by collimation apertures is known to cause variation of beam parameters due to contamination and charging of these elements by the ions.

Although the energy filter has been described above as comprising three electrodes, it is contemplated that the second 31 electrode may be omitted. Additionally, or alternatively, the electrodes of the energy filter need not be apertured electrodes by may be electrodes of other forms. For example, the energy filter electrodes may be a segmented multipole (e.g. quadrupole) having two, three or more axial segments and wherein different voltages may be applied to the electrodes of the different axial segments so as to perform the above-described energy filtering.

In order reflect the ions multiple times in the MRTOF mass analyser 1 before the ions impact on the detector 8, the velocity of the ions in the z-dimension (i.e. the drift dimension through the mass analyser) is required to be significantly smaller than the velocity of the ions in the direction of ion reflection between the ion mirrors 2 (i.e. in the x-dimension). However, it can be difficult to arrange the ion beam incoming into the MRTOF mass analyser so have sufficiently low velocity (i.e. energy) in the z-dimension. Also, even though the ions may be collisionally cooled upstream of the MRTOF mass analyser in order to reduce their energy spread, the ions may still emerge from the collisional cooling cell 12 having a substantial spread of kinetic energies. It can also be problematic to simply set the energy filter 14 so as to transmit only ions in a narrow energy band, such as those having energies above a relatively high cut-off value, since then relatively few ions will be transmitted by the energy filter and the sensitivity of the instrument will be diminished.

The maximum number of double ion-mirror reflections before ions begin to undergo differing numbers of ion-mirror reflections can be estimated approximately as the ratio of the drift length of the ions through the MRTOF mass analyser in z-dimension to the size of ion packet in z-dimension. Even if the ion packet begins with very small size in the z-dimension, this size will expand as the ions travel through the mass analyser and according to the following relationship:

$$\Delta Z = \Delta V_z * L_z / V_z$$

where $\Delta Z$ is the change in size of the ion packet in the z-dimension as it travels through the MRTOF mass analyser, $\Delta V_z$ is the spread of ion velocities in the z-dimension that the ions have, $L_z$ is the length that the ions travel in the z-dimension in the MRTOF mass analyser, and $V_z$ is the average ion velocity in the z-dimension within the MRTOF mass analyser.

Therefore, the number of reflections between the ion mirrors is restricted by the ratio of $V_z$ to $\Delta V_z$, which is approximately equal to $2E_{beam}/E_{beam}$, where $E_{beam}$ is the average energy of the ion beam in the z-dimension that enters the MRTOF mass analyser and $\Delta E_{beam}$ is the spread of energies in the z-dimension of ions that enter the mass analyser.

The above does not take into account the original size of the ion packet in the z-dimension (e.g. at the orthogonal accelerator) $Z_0-\Delta Z$. Accounting for the original size of the ion beam in the z-dimension may result in an increase in the final size of the ion beam in the z-dimension by the time at the time it reaches the detector, with a corresponding decrease (approximately by a factor of two) in the number of ion mirror reflections that may be performed whilst still maintaining the same number of ion mirror reflections for all ions. Therefore, the number of ion mirror reflections that may be performed whilst maintaining the same number of reflections for all ions, $N_{max}$, may be given by:

$$N_{max} \sim E_{beam}/\Delta E_{beam}$$

It therefore follows that it is required to minimize the energy spread of ions entering the MRTOF mass analyser, $\Delta E_{beam}$, using the collisional cooling cell and energy filter in order to maximise the number of ion mirror reflections $N_{max}$.

In order to increase the number of ion mirror reflections, $N_{max}$, so as to increase the ion flight path length, and hence increase the resolving power of the MRTOF mass analyser, the energy of the original ion beam $E_{beam}$ may be increased. The velocity of the ions in the z-dimension through the mass analyser may then be decreased such that the ions have time to perform the desired number of reflections before they reach the detector. This reduction of the ion velocity in the z-dimension may be performed by a deflection module arranged downstream of the orthogonal accelerator that deflects the ion packet leaving the orthogonal accelerator so that its component of velocity in the z-dimension is decreased (and its component of velocity in the x-dimension is increased), as will be described below in relation to FIG. 6.

A disadvantages of this approach (and other approaches that increase the number of ion mirror reflections) is that the duty cycle of the mass analyser is reduced, i.e. the proportion of the ions that are transmitted from the entrance of the mass analyser to the detector is reduced. Without the use of a deflection module, the duty cycle (DC) of the mass analyser can be estimated (assuming $Z_0 \sim \Delta Z$) as follows:

$$DC = Z_0/L_Z \sim \tfrac{1}{2} N_{max}$$

If a deflection module is used to decrease the ion trajectory angle (relative to the x-dimension) and increase the number of ion mirror reflections, as described above, then the duty cycle is additionally reduced in proportion to the decrease in the ion trajectory angle.

In order to better understand the effect of using a deflection module, a numerical example will now be described. Assuming that an MRTOF mass analyser having no deflection module has been set up so that the number of ion mirror reflections are optimised, and it is desired to improve the resolving power of the mass analyser (i.e. the ion flight path length and hence number of reflections) by a factor Q, then the energy of the incoming ion beam may be increased and a deflection module may be provided after the orthogonal accelerator (whilst retaining the same energy spread in the incoming ion beam and the same drift length $L_z$ through the mass analyser). The increase in ion beam energy and use of the deflection module alters the main parameters of the mass analyser by the factors listed below, where the second column indicates the factors in general terms and the third column indicates the factors for an example in which the resolution is increased by a factor of 2 (i.e. Q=2).

| | | |
|---|---|---|
| Resolution | Q | 2 |
| $N_{max}$ | Q | 2 |
| $\Delta V_z$ | $1/Q^2$ | 0.25 |
| $V_z$ | $Q^2$ | 4 |
| Beam Energy | $Q^4$ | 16 |
| Time of flight | Q | 2 |
| OA length | 1/Q | 0.5 |
| Duty Cycle | $Q^{-4}$ | 0.0625 |
| $L_Z$ | 1 | 1 |

It can be seen that the resolution and number of reflections $N_{max}$ are increased, but the required length of the orthogonal accelerator (OA) and the duty cycle are reduced.

If a deflection module is not used then in order to achieve the same increase in resolving power, the main parameters of the mass analyser are required to be varied by the factors listed below, where the second column indicates the factors in general terms and the third column indicates the factors for an example in which the resolution is increased by a factor of 2 (i.e. Q=2).

| | | |
|---|---|---|
| Resolution | Q | 2 |
| $N_{max}$ | Q | 2 |
| $V_z$ | $Q^{1/2}$ | 1.4 |
| $\Delta V_z/V_z$ | 1/Q | 0.5 |
| Beam energy | Q | 2 |
| Time of flight | Q | 2 |
| OA length | $Q^{1/2}$ | 1.4 |
| Duty Cycle | 1/Q | 0.5 |
| $L_z$ | $Q^{3/2}$ | 2.8 |

It can be seen that the required length of the orthogonal accelerator (OA) and the drift length through the mass analyser $L_z$ are required to be increased.

Figure 6:
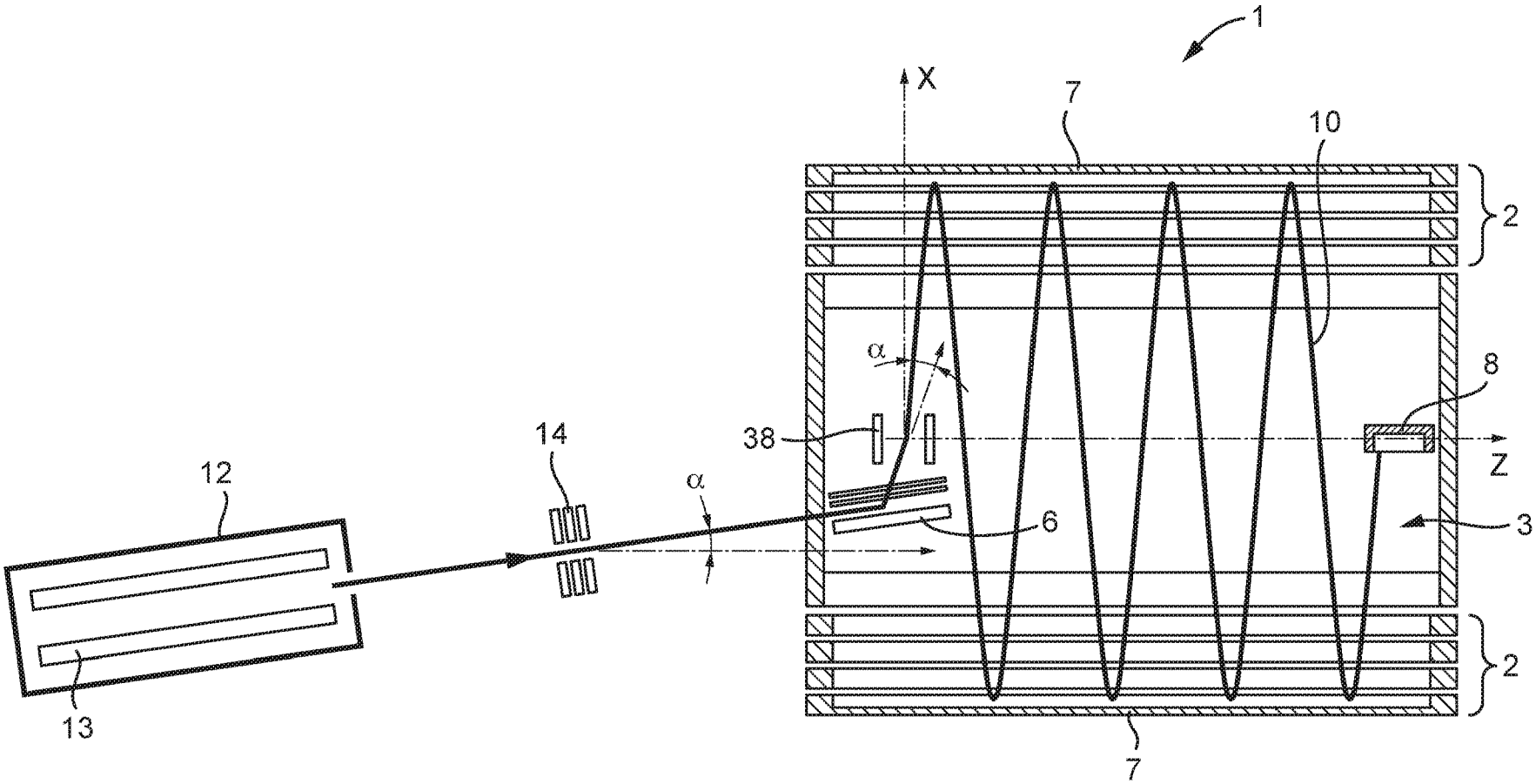
FIG. 6 shows a schematic of part of an MRTOF mass spectrometer according to an embodiment of the present invention in which the orthogonal accelerator is inclined.

FIG. 6 shows an embodiment of the present invention including an MRTOF mass analyser 1 that is similar to that shown and described in relation to FIG. 3, except that the orthogonal accelerator 6 has its ion receiving axis tilted with respect to the z-dimension and the mass analyser includes a deflection module 38 for reducing the velocity of the ions in the z-dimension after the ions have been orthogonally accelerated by the orthogonal accelerator 6. The energy filter 14 shown in FIG. 6 is also of the type shown and described in relation to FIG. 5 rather than an electric sector as shown in FIGS. 3-4, although an electric sector energy filter or any other energy filter may be used. In this embodiment, the ions may be accelerated to a relatively high energy between the collisional cooling cell 12 and the orthogonal accelerator 6.

In this embodiment the deflection module 38 comprises two deflection electrodes spaced apart in the z-dimension and arranged so that ions pulsed out of the orthogonal accelerator 6 pass between them. Voltages are applied to these deflection electrodes so as to change the trajectory of the ions such that the ions have a lower velocity component in the z-dimension, thereby increasing the number of reflections between the ion mirrors 2. It is known to use deflection electrodes in order to control the trajectory of the ions after the orthogonal accelerator 6. However, the deflection electrodes may introduce first order aberrations to the time of flight of the ions that is proportional to the size of the ion packet in the z-dimension (due to the angle of trajectory of the ion packet at the exit of the deflection region). Embodiments of the present invention eliminate these aberrations by arranging the orthogonal accelerator 6 so that its ion receiving axis is inclined at an acute angle $\alpha$ to the z-dimension. The ions are then pulsed into the region between the deflection electrodes by the orthogonal accelerator 6 along a first trajectory, and the deflection electrodes deflect the ions by an angle α towards the x-dimension so that they travel more orthogonally to the elongated ion mirrors 2.

In the embodiments that comprise a deflection module 38, second order positive z-dimension aberrations may introduced by a lens-effect. These aberrations may be compensated for by intentionally introduced negative z-dimension aberrations. For example, this may be achieved through the use of a gridless orthogonal accelerator, e.g. having accelerating slots that operate as an immersion lens and provide the compensating negative second-order aberrations.

According to the embodiments described herein, the ions have a relatively long time of flight in the MRTOF mass analyser 1 due to the multiple reflections between the ion mirrors 2. This enables the ions in each pulse to become temporally well separated in the time of flight region, thus providing the instrument with a high resolution. However, due to this high temporal separation of the ions, pulsing the ions into the MRTOF at too high a rate would lead to spectral overlap in which slow ions from a first ion injection pulse are detected after fast ions from a second, later ion injection pulse. This limits the rate at which ions can be pulsed into the MRTOF before spectral overlap occurs, thus limiting the duty cycle of the instrument. Also, as described above, the use of the deflection module 38 may reduce the duty cycle of the instrument. In order to overcome this problem, the instrument may be operated in an encoded frequency pulsing (EFP) mode. In this mode, the orthogonal accelerator 6 pulses ions into the Time of Flight region in a series of pulses, wherein the time delay between pairs of adjacent ion injection pulses is varied in a predetermined manner, as opposed to the conventional method of employing a uniform time delay between all of the pairs of adjacent pulses. The ions may then be pulsed into the ion mirrors at a relatively high rate, in which the ions in a first pulse temporally overlap with the ions in a subsequent pulse. The detector 8 then detects the arrival times of the ions and obtains a signal corresponding to the overlapping spectra. As the variable time delays between ion injection pulses are known in the EFP method, this can be used to unpick overlapping peaks in the TOF spectra so as to obtain non-overlapping spectra. This may be performed by correlating the overlapping spectra with the encoded sequence for injecting ions into the flight region 3. The EFP mode enables ions to be injected into the TOF device at time intervals that are shorter than the TOF separation time and so enables the duty cycle of the spectrometer to be increased.

Although the present invention has been described with reference to preferred embodiments, it will be understood by those skilled in the art that various changes in form and detail may be made without departing from the scope of the invention as set forth in the accompanying claims.

For example, although the embodiments have been described in relation to an MRTOF mass analyser having a detector for determining the mass to charge ratios of the ions, it is alternatively contemplated that the ion mirrors may simply provide a mass separation region without a TOF detector.

The invention claimed is:

1. A mass spectrometer comprising:

an ion energy filter arranged and configured to filter ions according to their kinetic energy and so as to only transmit ions having a component of kinetic energy in a first dimension (z-dimension) that is within a selected range; and a multi-reflecting time of flight mass analyser or mass separator having an ion accelerator, and two gridless ion mirrors that are elongated in the first dimension (z-dimension) and configured to reflect ions multiple times in a second orthogonal dimension (x-dimension), wherein the ion accelerator is arranged to receive ions from the energy filter and accelerate the ions into one of the ion mirrors;

wherein the energy filter is configured to only transmit ions having a kinetic energy spread, in the first dimension (z-dimension), of ≤5 eV.

2. The spectrometer of claim 1, comprising a controller for controlling the energy filter so as to only onwardly transmit ions having said component of kinetic energy in the first dimension (z-dimension) within the selected range such that substantially all of these transmitted ions are reflected the same number of times, N, between the ion mirrors.

3. The spectrometer of claim 2, wherein N is: ≥8; ≥9; ≥10; ≥11; ≥12; ≥13; ≥14; ≥15; ≥16; ≥17; ≥18; ≥19; or ≥20.

4. The spectrometer of claim 2, wherein substantially all ions having a component of kinetic energy in a first dimension (z-dimension) that is outside of the selected range would be reflected between the mirrors a number of times other than N, were they to be transmitted into the mass analyser or mass separator.

5. The spectrometer of claim 1, wherein the energy filter is configured to only transmit ions having a kinetic energy in the first dimension (z-dimension) that is above a first threshold value; and/or wherein the energy filter is configured to only transmit ions having a kinetic energy in the first dimension (z-dimension) that is below a second threshold value.

6. The spectrometer of claim 1, wherein the energy filter is configured to only transmit ions having a kinetic energy spread, in the first dimension (z-dimension), that is selected from: ≤4 eV; ≤3 eV; ≤2 eV; ≤1 eV; ≤0.9 eV; ≤0.8 eV; ≤0.7 eV; ≤0.6 eV; ≤0.5 eV; ≤0.4 eV; ≤0.3 eV; ≤0.2 eV; or ≤0.1 eV.

7. The spectrometer of claim 1, wherein the energy filter comprises at least one electrostatic sector for filtering ions according to their kinetic energy.

8. The spectrometer of claim 1, wherein the mass analyser or separator comprises a deflection module configured to deflect the average trajectory of the ions leaving the ion accelerator towards the second dimension (x-dimension) so as to reduce the velocity component of these accelerated ions in the first dimension (z-dimension).

9. The spectrometer of claim 1, comprising an ion cooling device upstream of the energy filter for reducing the average energy of the ions received by the energy filter.

10. The spectrometer of claim 9, wherein the ion cooling device is a collisional cooling cell configured to be maintained at a gas pressure such that ions collide with gas in the cell to reduce their energy.

11. The spectrometer of claim 1, wherein the mass analyser or separator is configured such that ions are substantially not spatially focussed and/or collimated in the first dimension (z-dimension) as the ions travel between the ion mirrors; or wherein the mass analyser or separator is configured such that there are substantially no aberrations due to spatial focusing in the first dimension (z-dimension) as the ions travel between the ion mirrors.

12. The spectrometer of claim 1, wherein the two ions mirrors are configured to reflect ions over substantially the same length in the first dimension (z-dimension).

13. The spectrometer of claim 1, wherein the mass analyser or mass separator comprises an ion accelerator for accelerating ions into one of the ion mirrors and that is arranged between the ion mirrors; and/or comprising an ion detector for detecting ions after having been reflected by the ion mirrors and that is arranged between the ion mirrors.

14. The spectrometer of claim 1, wherein the mass analyser or separator is housed in a housing and the spectrometer further comprises an ion source, and/or at least one ion manipulation device, mounted to or arranged adjacent a wall of the housing; wherein the spectrometer is configured to transmit ions from the ion source, and/or through the at least one ion manipulation device, in a first direction and then turn the ions in a second, opposite direction and into the mass analyser or separator.

15. A method of mass spectrometry comprising:

providing a spectrometer as claimed in claim 1;

controlling the ion energy filter to filter ions according to their kinetic energy and so as to only transmit ions having a component of kinetic energy in a first dimension (z-dimension) that is within a selected range;

accelerating the transmitted ions into one of the ion mirrors using the ion accelerator; and reflecting the ions between the ion mirrors multiple times.

16. A mass spectrometer comprising:

an ion energy filter arranged and configured to filter ions according to their kinetic energy and so as to only transmit ions having a component of kinetic energy in a first dimension (z-dimension) that is within a selected range; and a multi-reflecting time of flight mass analyser or mass separator having an ion accelerator, and two gridless ion mirrors that are elongated in the first dimension (z-dimension) and configured to reflect ions multiple times in a second orthogonal dimension (x-dimension), wherein the ion accelerator is arranged to receive ions from the energy filter and accelerate the ions into one of the ion mirrors;

wherein the energy filter comprises an ion entrance, an ion exit, and at least two axially spaced electrodes arranged therebetween, wherein the energy filter is configured to arrange a potential difference between the electrodes that urges ions in a direction from the ion exit to the ion entrance for filtering the ions according to their kinetic energy.

17. The spectrometer of claim 16, wherein the energy filter is configured such that ions travel therethrough along a central axis, and wherein the electrodes are arranged and configured such when the potential difference is arranged between them it provides an axial potential barrier that increases as a function of radial distance from the central axis.

18. The spectrometer of claim 16, wherein said electrodes comprise a first electrode arranged towards the ion entrance, a second electrode arranged towards the ion exit, and a third electrode arranged between the first and second electrodes; wherein the energy filter is configured to maintain the first and second electrodes at the same potential and the third electrode at a different potential.

* * * * *